US010480886B2

(12) United States Patent
Hibbitts et al.

(10) Patent No.: US 10,480,886 B2
(45) Date of Patent: Nov. 19, 2019

(54) SUPPRESSOR DESIGN

(71) Applicant: Gladius Suppressor Company, LLC, Laurens, SC (US)

(72) Inventors: John McCartney Hibbitts, Laurens, SC (US); Robert Randall Mace, Jr., Laurens, SC (US)

(73) Assignee: Gladius Suppressor Company, LLC, Laurens, SC (US)

( * ) Notice: Subject to any disclaimer, the term of this patent is extended or adjusted under 35 U.S.C. 154(b) by 0 days.

(21) Appl. No.: 15/876,397

(22) Filed: Jan. 22, 2018

(65) Prior Publication Data

US 2018/0209757 A1 Jul. 26, 2018

Related U.S. Application Data

(60) Provisional application No. 62/448,412, filed on Jan. 20, 2017.

(51) Int. Cl.
*F41A 21/30* (2006.01)
*F41A 21/44* (2006.01)

(52) U.S. Cl.
CPC ..... *F41A 21/30* (2013.01); *F41A 21/44* (2013.01)

(58) Field of Classification Search
CPC ..... F41A 21/30; F41A 21/44
See application file for complete search history.

(56) References Cited

U.S. PATENT DOCUMENTS

| | | | | |
|---|---|---|---|---|
| 4,396,661 | A * | 8/1983 | George | C04B 41/009 427/419.1 |
| 8,087,338 | B1 * | 1/2012 | Hines | F41A 21/30 181/223 |
| 8,567,556 | B2 | 10/2013 | Dueck | |
| 8,967,325 | B1 | 3/2015 | Cronhelm | |
| 9,658,010 | B1 * | 5/2017 | Oglesby | F41A 13/12 |
| 9,933,223 | B2 * | 4/2018 | Latka | F41A 21/30 |
| 10,036,606 | B2 * | 7/2018 | Roberts | F41A 21/30 |
| 10,113,826 | B2 * | 10/2018 | Bray | F41A 21/34 |
| 2017/0299291 | A1 * | 10/2017 | Spector | F41G 11/003 |
| 2017/0299314 | A1 * | 10/2017 | Palu | F41A 21/30 |
| 2018/0164065 | A1 * | 6/2018 | Mohler | F41A 21/30 |

FOREIGN PATENT DOCUMENTS

RU 2437048 C1 12/2011

OTHER PUBLICATIONS

Aaron, "Gemtech G-Core Suppressors" by Aaron (hereinafter "Gemtech"), https://www.thefirearmblog.com/blog/2014/01/16/gemtech-g-core-suppressors/ (Year: 2014).*

Thermal Cloak Prevents Weapon Detection by Thermal Imagers, Jan. 26, 2015, https://www.defencetalk.com/thermal-cloak-prevents-weapon-detection-by-thermal-imagers-62182/.

* cited by examiner

*Primary Examiner* — Joshua T Semick
(74) *Attorney, Agent, or Firm* — Burr & Forman LLP; Douglas L. Lineberry

(57) ABSTRACT

An improved design for a suppressor which suppresses sound from a gun report as well as reduces heat transference therefrom.

20 Claims, 34 Drawing Sheets

| Position | Average | Max | Min |
|---|---|---|---|
| 3 | 132.80 | 166.19 | 75.15 |
| 6 | 136.18 | 173.02 | 76.60 |
| 9 | 136.13 | 168.04 | 77.81 |
| 12 | 136.13 | 182.57 | 63.06 |
| Average | 135.31 | 172.45 | 73.16 |

| Position | Average | Max | Min |
|---|---|---|---|
| 3 | 185.07 | 225.75 | 97.45 |
| 6 | 188.96 | 232.18 | 96.79 |
| 9 | 184.35 | 232.24 | 71.50 |
| 12 | 194.62 | 245.74 | 90.66 |
| Average | 188.50 | 233.98 | 89.10 |

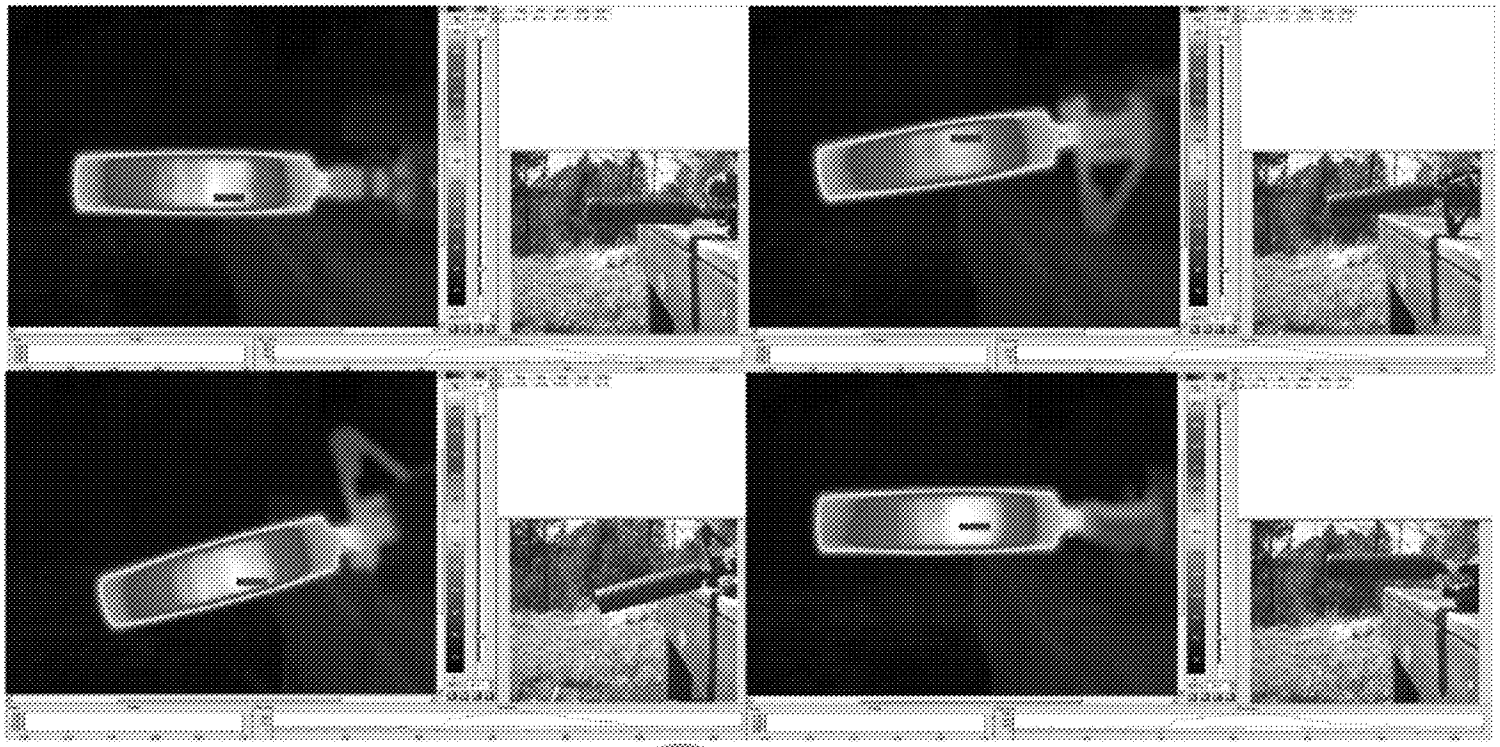
Top Left: 9 O'clock View
Top Right: 3 O'clock View
Bottom Left: 6 O'clock View
Bottom Right: 12 O'clock View
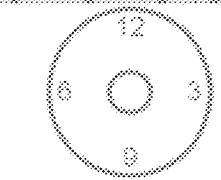
Looking at the Muzzle
| Position | Average | Max | Min |
|---|---|---|---|
| 3 | 227.30 | 275.67 | 127.96 |
| 6 | 233.13 | 287.40 | 96.02 |
| 9 | 229.72 | 279.59 | 103.21 |
| 12 | 237.15 | 294.44 | 113.13 |
| Average | 231.85 | 284.28 | 110.08 |
FIGURE 21

| | Average (°C) | Max (°C) | Min (°C) |
|---|---|---|---|
| W/out Insulation | 231.85 | 284.28 | 110.08 |
| w/ Insulation | 52.2 | 84.72 | 30.85 |
| Delta | 179.65 | 199.56 | 79.23 |
| % Lower | 77.49% | 70.20% | 71.97% |

FIGURE 22

Gladius Silencer Thermography: 150 Round Test

| | | | Barrel / Mount Interface | | | Suppressor | | | |
|---|---|---|---|---|---|---|---|---|---|
| Time | Approximate Round Count | Side | Average (°F) | Min (°F) | Max (°F) | Average (°F) | Min (°F) | Max (°F) | Target (°F) |
| 0.00 | 0.00 | LHS | 77.46 | 64.61 | 83.28 | 87.58 | 82.42 | 90.19 | 160.00 |
| 0.00 | 0.00 | RHS | 78.71 | 71.82 | 83.50 | 85.94 | 77.74 | 88.89 | 160.00 |
| 30.00 | 11.54 | LHS | 125.56 | 93.98 | 143.23 | 88.18 | 84.58 | 90.70 | 160.00 |
| 30.00 | 19.23 | RHS | 139.35 | 95.89 | 167.76 | 87.17 | 74.11 | 114.76 | 160.00 |
| 65.00 | 23.00 | LHS | 167.76 | 106.51 | 204.92 | 95.17 | 89.51 | 118.87 | 160.00 |
| 80.00 | 30.77 | RHS | 181.86 | 123.49 | 231.98 | 95.21 | 83.23 | 126.44 | 160.00 |
| 90.00 | 34.62 | LHS | 196.90 | 99.67 | 251.29 | 104.45 | 26.40 | 139.06 | 160.00 |
| 105.00 | 40.38 | RHS | 205.51 | 116.27 | 270.43 | 107.56 | 83.77 | 145.21 | 160.00 |
| 120.00 | 46.15 | LHS | 244.07 | 108.10 | 303.17 | 119.46 | 100.19 | 152.60 | 160.00 |
| 135.00 | 51.92 | RHS | 253.43 | 112.91 | 313.36 | 119.22 | 78.65 | 153.47 | 160.00 |
| 150.00 | 57.69 | LHS | 248.44 | 122.51 | 310.79 | 130.31 | 108.12 | 160.20 | 160.00 |
| 165.00 | 63.46 | RHS | 250.98 | 174.12 | 313.32 | 130.77 | 89.98 | 153.48 | 160.00 |
| 180.00 | 69.23 | LHS | 285.90 | 139.46 | 341.20 | 146.60 | 106.35 | 173.63 | 160.00 |
| 195.00 | 75.00 | RHS | 296.78 | 152.77 | 359.93 | 152.28 | 87.19 | 186.32 | 160.00 |
| 215.00 | 82.69 | LHS | 277.83 | 104.62 | 376.02 | 166.28 | 111.40 | 218.54 | 160.00 |
| 225.00 | 86.54 | RHS | 298.06 | 139.37 | 384.83 | 174.48 | 123.43 | 215.32 | 160.00 |
| 240.00 | 92.31 | LHS | 317.98 | 113.78 | 401.03 | 189.32 | 140.80 | 251.46 | 160.00 |
| 255.00 | 98.08 | RHS | 306.00 | 122.66 | 401.92 | 198.68 | 153.95 | 241.33 | 160.00 |
| 300.00 | 115.38 | LHS | 336.58 | 127.91 | 410.85 | 213.86 | 165.82 | 278.43 | 160.00 |
| 315.00 | 121.15 | RHS | 354.55 | 233.46 | 437.00 | 216.11 | 144.02 | 279.34 | 160.00 |
| 320.00 | 123.08 | LHS | 391.23 | 184.45 | 457.50 | 236.38 | 167.80 | 334.90 | 160.00 |
| 335.00 | 128.85 | RHS | 400.36 | 196.89 | 473.16 | 235.06 | 130.00 | 278.31 | 160.00 |
| 360.00 | 138.46 | LHS | 374.11 | 126.28 | 466.87 | 257.64 | 153.54 | 348.75 | 160.00 |
| 390.00 | 150.00 | RHS | 393.30 | 120.35 | 481.20 | 253.98 | 152.04 | 310.83 | 160.00 |
| 510.00 | - | LHS | | | | 341.37 | 146.83 | 471.89 | 160.00 |
| 525.00 | - | RHS | | | | 335.12 | 98.23 | 487.84 | 160.00 |
| 690.00 | - | LHS | | | | 340.02 | 175.23 | 442.61 | 160.00 |
| 705.00 | - | RHS | | | | 327.82 | 189.93 | 421.64 | 160.00 |
| 990.00 | - | LHS | | | | 279.31 | 104.50 | 333.96 | 160.00 |
| 1005.00 | - | RHS | | | | 275.93 | 137.19 | 320.63 | 160.00 |
| 1290.00 | - | LHS | | | | 226.46 | 95.88 | 261.93 | 160.00 |
| 1305.00 | - | RHS | | | | 220.96 | 122.74 | 268.71 | 160.00 |
| 1390.00 | - | LHS | | | | 208.98 | 100.83 | 235.72 | 160.00 |
| 1415.00 | - | RHS | | | | 203.32 | 109.87 | 221.21 | 160.00 |

Gladius Silencer Failure Test : 240 rounds rapid fire

| | | | Barrel / Mount Interface | | | Suppressor | | | |
|---|---|---|---|---|---|---|---|---|---|
| Approx. Time | Round Count | Side | Average (°F) | Min (°F) | Max (°F) | Average (°F) | Min (°F) | Max (°F) | Target (°F) |
| 0.00 | 0.00 | RHS | 78.71 | 71.82 | 83.50 | 85.94 | 77.74 | 88.89 | 160.00 |
| 90.00 | 90.00 | RHS | 305.24 | 183.82 | 374.74 | 148.55 | 114.16 | 199.07 | 160.00 |
| 110.00 | 110.00 | RHS | 320.21 | 172.63 | 393.38 | 152.35 | 92.24 | 199.68 | 160.00 |
| 120.00 | 120.00 | RHS | 344.39 | 234.44 | 420.83 | 163.52 | 101.85 | 194.61 | 160.00 |
| 150.00 | 150.00 | RHS | 353.60 | 216.52 | 426.18 | 211.37 | 146.91 | 270.15 | 160.00 |
| 180.00 | 180.00 | LHS | 444.34 | 241.67 | 555.14 | 273.60 | 162.70 | 349.57 | 160.00 |
| 220.00 | 220.00 | LHS | 541.26 | 383.11 | 665.05 | 326.94 | 196.68 | 433.76 | 160.00 |
| 240.00 | 240.00 | LHS | 635.07 | 287.98 | 781.67 | 382.33 | 219.49 | 516.71 | 160.00 |
| 300.00 | 240.00 | RHS | 686.56 | 281.59 | 821.82 | 387.21 | 198.17 | 550.45 | 160.00 |
| 360.00 | 240.00 | LHS | 652.99 | 319.02 | 742.17 | 460.79 | 287.64 | 555.50 | 160.00 |

SilencerCo Comparison

| | | | Barrel / Mount Interface | | | Suppressor | | | |
|---|---|---|---|---|---|---|---|---|---|
| Time | Approximate Round Count | Side | Average (°F) | Min (°F) | Max (°F) | Average (°F) | Min (°F) | Max (°F) | Target (°F) |
| 0 | 0.00 | LHS | | | | 90.75 | 76.5 | 95.99 | - |
| 0 | 0.00 | RHS | | | | 86.6 | 77.5 | 91.56 | - |
| 30 | 13.85 | LHS | | | | 312.08 | 132.38 | 382.54 | - |
| 45 | 20.77 | RHS | | | | 339.41 | 109.51 | 453.54 | - |
| 60 | 27.69 | RHS | | | | 418.46 | 94.18 | 572.35 | - |
| 65 | 30.00 | LHS | | | | 471.69 | 147.76 | 626.1 | - |
| 365 | | RHS | | | | 390 | 144.14 | 513.21 | - |

FIGURE 28

| A | B | C | D |
|---|---|---|---|
| Left Ear | Left Ear | Right Ear | Right Ear |
| 140.8 | 136.3 | 136.3 | 136.3 |
| 137.2 | 136.0 | 136 | 136 |
| 136.2 | 136.1 | 136.1 | 136.1 |
| 136.4 | 136.3 | 136.3 | 136.3 |
| 135.8 | 137.4 | 137.4 | 137.4 |
| 135.8 | 134.3 | 134.3 | 134.3 |
| 136.1 | 136.4 | 136.4 | 136.4 |
| 137.3 | 136.0 | 136 | 136 |
| 135.9 | 137.5 | 137.5 | 137.5 |
| 137.1 | 136.8 | 136.8 | 136.8 |
| 135.1 | 137.2 | 137.2 | 137.2 |
| 136.1 | 137.5 | 137.5 | 137.5 |
| 135.6 | 136.8 | 136.8 | 136.8 |
| 136.1 | 136.3 | 136.3 | 136.3 |
| 135.2 | 137.4 | 137.4 | 137.4 |
| 135.9 | 137.1 | 137.1 | 137.1 |
| 135.9 | 138.2 | 138.2 | 138.2 |
| 134.2 | 137.0 | 137 | 137 |
| 135.0 | 139.3 | 139.3 | 139.3 |
| 135.4 | 138.3 | 138.3 | 138.3 |
| 135.1 | 137.3 | 137.3 | 137.3 |
| 134.1 | 138.8 | 138.8 | 138.8 |
| 133.1 | 138.3 | 138.3 | 138.3 |
| 134.2 | 138.0 | 138 | 138 |
| 133.3 | 136.3 | 136.3 | 136.3 |
| 135.0 | 137.6 | 137.6 | 137.6 |
| 134.5 | 137.7 | 137.7 | 137.7 |
| 135.0 | 138.6 | 138.6 | 138.6 |
| 135.0 | 138.0 | 138 | 138 |
| 135.1 | | | |

FIGURE 29

SUPPRESSOR DESIGN

BACKGROUND OF THE INVENTION

1) Field of the Invention

The present invention relates to an improved design for a suppressor which suppresses sound from a gun report as well as reduces heat transference therefrom.

2) Description of Related Art

A suppressor, sound suppressor, sound moderator, silencer, or "can" is a device attached to or part of the barrel of a firearm or air gun which reduces the amount of noise and visible muzzle flash generated by firing. Silencers are typically constructed of a metal cylinder with internal mechanisms to reduce the sound of firing by slowing the escaping propellant gas and can also slightly increase the speed of the bullet.

In most countries, silencers are regulated by firearm legislation to varying degrees. While some have allowed for sporting use of silencers (especially to mitigate hearing loss and noise pollution), other governments have opted to ban them from civilian use.

When a firearm is discharged, there are three ways sound is produced. Part of it can be managed; however, some of it is beyond the ability of the operator or manufacturers to eliminate. In order of importance, the three ways a firearm generates sound are: muzzle blast (high-temperature, high-pressure gases escaping after bullet), sonic boom (sound associated with shock waves created by an object exceeding the speed of sound), and mechanical noise (moving parts of the firearm).

A suppressor can only affect the noise generated by the two primary sources—muzzle blast and sonic boom—and in most cases only the former. While subsonic ammunition can negate the sonic boom, mechanical noise can be mitigated but is nearly impossible to eliminate. For these reasons, it is difficult to completely silence any firearm, or achieve an acceptable level of noise suppression in revolvers that function under standard operating principles. Some revolvers have technical features that enable suppression and include the Russian Nagant M1895 and OTs-38 revolvers, and the S&W QSPR.

Muzzle blast generated by discharge is directly proportional to the amount of propellant contained within the cartridge. Therefore, the greater the case capacity the larger the muzzle blast and consequently a more efficient or larger system is required. A gunshot (the combination of the sonic boom, the vacuum release, and hot gases) will almost always be louder than the sound of the action cycling of an auto-loading firearm. Properly evaluating the sound generated by a firearm can only be done using a decibel meter in conjunction with a frequency spectrum analyzer during live tests.

The suppressor is typically a hollow metal tube manufactured from steel, aluminum, or titanium and contains expansion chambers. This device, typically cylindrical in shape, attaches to the muzzle of a pistol, submachine gun, or rifle. Some "can"-type suppressors (so-called as they often resemble a beverage can), may be detached by the user and attached to a different firearm. Another type is the "integral" suppressor, which typically consists of an expansion chamber or chambers surrounding the barrel. The barrel has openings or "ports" which bleed off gases into the chambers. This type of suppressor is part of the firearm (thus the term "integral"), and maintenance of the suppressor requires that the firearm be at least partially disassembled.

Suppressors reduce noise by allowing the rapidly expanding gases from the firing of the cartridge to be decelerated and cooled through a series of hollow chambers. The trapped gas exits the suppressor over a longer period of time and at a greatly reduced velocity, producing less noise signature. The chambers are divided by either baffles or wipes. There are typically at least four and up to perhaps fifteen chambers in a suppressor, depending on the intended use and design details. Often, a single, larger expansion chamber is located at the muzzle end of a can-type suppressor, which allows the propellant gas to expand considerably and slow down before it encounters the baffles or wipes. This larger chamber may be "reflexed" toward the rear of the barrel to minimize the overall length of the combined firearm and suppressor, especially with longer weapons such as rifles.

Two ancillary advantages to the suppressor are recoil reduction and flash suppression. Muzzle flash is reduced by both being contained in the suppressor and through the arresting of unburned powder that would normally burn in the air, adding to the flash. Recoil reduction results from the slowing of propellant gasses, which can contribute 30-50% of recoil velocity. The weight of suppressor and the location of that additional weight at the muzzle reduce recoil through basic mass as well as muzzle flip due to the location of this mass.

Various types of suppressors are known in the art. For example, U.S. Pat. No. 4,454,798 discloses a device for reducing the muzzle blast and flash from large caliber guns. A container having a plurality of internal chambers and baffle plates filled with an aqueous foam is mounted to the muzzle of the gun barrel. The foam and chambers co-operate to substantially suppress muzzle blast noise and completely suppress muzzle flash.

U.S. Pat. No. 7,350,620 discloses a silencer for attenuating sound waves produced in a fluid that circulates through a fluid conveyer. The silencer comprises an expansion chamber that is in fluid communication with the fluid conveyer, and which carries sound waves there through; a sound wave dissipater provided with the expansion chamber and arranged to absorb sound waves traveling there through; a resonator operatively associated with the sound wave dissipater and constructed and arranged to cause attenuation and reflection of the sound waves back and forth towards the sound wave dissipater; the expansion chamber having a chamber: conveyer cross-sectional area ratio and chamber length characteristics allowing maximum transmission loss for a given frequency. The expansion chamber has an exit to allow fluid containing attenuated sound waves to escape therefrom. FIGS. 1 and 2 show a plan and internal view of the suppressor of the '620 patent.

U.S. Pat. No. 2,514,996 provides a flash eliminator and silencer for firearms. FIG. 3 illustrates the invention. The '996 disclosure includes a concentric cylindrical casing with an inner casing composed of a wire screen fixed to end plates via rivets. Multiple baffles are included within the cylindrical body.

U.S. Pat. Pub. No. 2015/0338184 discloses a gun barrel having a circumferential series of lands, each land among the circumferential series of lands being radially displaced from the longitudinal axis a distance at least as great as one-half of the bullet's diameter, each land extending helically about the longitudinal axis; a plurality of sound reflection chambers, each sound reflection chambers among the plurality of sound reflection chambers being positioned between an adjacent pair of lands among the circumferential series of lands, each sound reflection chamber having a muzzle end, and each sound reflection chamber opening radially inwardly; and a plurality of sound reflection walls, each wall among the plurality of sound reflection walls closing one of the sound reflection chambers' muzzle ends.

U.S. Pat. No. 9,395,136 discloses a monocore baffle apparatus that includes a monocore frame having an interior section, wherein the interior section is positioned between a first end and a second end of the monocore frame. A shell is positioned about an exterior of the monocore frame. A plurality of tabs is connected to the monocore frame and extends into the interior section, wherein at least a portion of the plurality of tabs is flexibly connected to the monocore frame. FIG. 4 illustrates the '136 disclosure.

U.S. Pat. Pub. No. 2015/0354422 discloses a sound suppressing device that employs a porous micro-channel diffusion matrix surrounding a hollow core tube that acts to exponentially increase the surface area of the suppressor and allow combustion gasses to diffuse and exit the suppressor across the entire outer surface of the suppressor.

U.S. Pat. No. 8,397,615 discloses a cover for use with a firearm sound suppressor that comprises an insulating body and a retention apparatus attached to the insulating body. The insulating body includes one or more layers of thermally-insulating material. The insulating body is configured for being wrapped around the firearm sound suppressor. The retention apparatus includes a securing structure configured for being wrapped around the insulating body to secure the insulating body in a fixed position with respect to the firearm sound suppressor after the insulating body is wrapped around the firearm sound suppressor.

U.S. Pat. No. 9,417,021 discloses a firearm suppressor that has a suppressor housing defining the outer surface of the suppressor, a mounting member for fastening/detaching the suppressor with a barrel of the firearm and having an aperture for a projectile and propellant gases of the firearm to enter the suppressor, an interior arranged to form a number of compartments, which are separated by conical baffles having an aperture for the projectile to pass through, an exit aperture for the projectile and the propellant gases to exit the suppressor, the compartments formed by the conical baffles are different in volume so that in the order of advancing projectile path (PP) the largest compartment is followed by number of smaller compartments.

U.S. Pat. No. 9,291,417 discloses a suppressor to diminish the volume of noise from firing having a suppressor body shape with tapered ends. The shape of the suppressor forms a partial wave-form to accommodate the wave-forms of the ignition gasses as they expand inside the chamber. Providing a chamber with a partial wave-form shaped interior space facilitates rapid dissipation of the expansion energy of the ignition gasses to quickly quell noise produced by such expansion. Perforated baffles housed in the interior chamber of the suppressor disrupt the fluid flow as the ignition gasses proceed through the chamber, which further dissipates the energy of the gasses. A fluid discharge port evacuates fluid from the primary chamber of the suppressor.

Accordingly, it is an object of the present invention to provide a sound suppressor that also insulates and protects the user from heat generated during firing a firearm.

SUMMARY OF THE INVENTION

The above objectives are accomplished according to the present invention by providing an insulated suppressor for a rifle. The suppressor may include an insulating sleeve, which may further include a continuous cylindrical wall, a distal end cap, and a proximal end cap. The insulating sleeve may substantially cover the entirety of a suppressor. The suppressor may further include a blast baffle and a monocore baffle stack.

In a further embodiment, the insulating sleeve is made integral with the suppressor. In a still further embodiment, the insulating sleeve defines only two orifices within an outer surface of the insulating sleeve. In a yet further embodiment, one orifice is defined in the distal end cap and one orifice is defined in the proximal end cap. In a still further embodiment, the monocore baffle stack comprises a sinusoidal structure. In another embodiment, the suppressor may include a second continuous cylindrical wall. In a still further embodiment, a void is defined between the continuous cylindrical wall and the second continuous cylindrical wall. In a further embodiment, the void is filled with an insulating material. Still further, the void filled with insulating material substantially covers the entirety of the outer circumference and length of the suppressor. Even further, the insulating material may comprise a ceramic and silica mixture. In another embodiment, the insulating material underlies the distal end cap and proximal end cap. Still further, the void may comprise a vacuum.

In another embodiment, a method is provided for reducing noise and heat generated from a suppressor. The method may include integrally forming an insulating sleeve around a suppressor. The insulating sleeve may include a continuous cylindrical wall, a distal end cap, and a proximal end cap. The insulating sleeve may substantially cover an outer surface of the suppressor. A void may be formed around at least a circumference of the suppressor. In a further embodiment, the void may be filled with an insulating material. In a still further embodiment, only two orifices are formed in the insulating sleeve. Still further, a first orifice may be formed in the proximal end cap and a second orifice may be formed in the distal end cap. In a further embodiment, a vacuum is formed in the void. In a still yet further embodiment, the insulating material comprises a ceramic and silica mixture. Even further, the insulating material may be positioned under the distal end cap and proximal end cap. In a further embodiment, the void may be formed to substantially circumferentially cover the outer circumference of the suppressor. In a further embodiment, the void may be formed to extend at least the length of the suppressor. Even still further, the insulated sleeve may be integrally formed by permanently affixing the insulating sleeve to the suppressor.

In a further embodiment, an insulated suppressor for a rifle is provide. The suppressor includes an inner insulating wall forming a continuous cylinder and an outer insulating wall forming a continuous cylinder. The outer and inner insulating walls define a sealed void between the inner and outer insulating wall. The suppressor also includes a distal end cap and a proximal end cap. Further, the continuous cylinder of the inner insulating wall surrounds a blast baffle and a monocore baffle stack. A carbon fiber wrap at least partially surrounds the outer insulating wall.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 21 shows a suppressor without insulation after sixty (60) rounds have been fired.

FIG. 22 shows average thermography measurements for a suppressor of the current disclosure in chart form.

FIG. 28 shows the raw data taken from the IR Thermography tests.

FIG. 29 shows decibel readings recorded at a shooter's ear and next to the muzzle.

Figure 1:
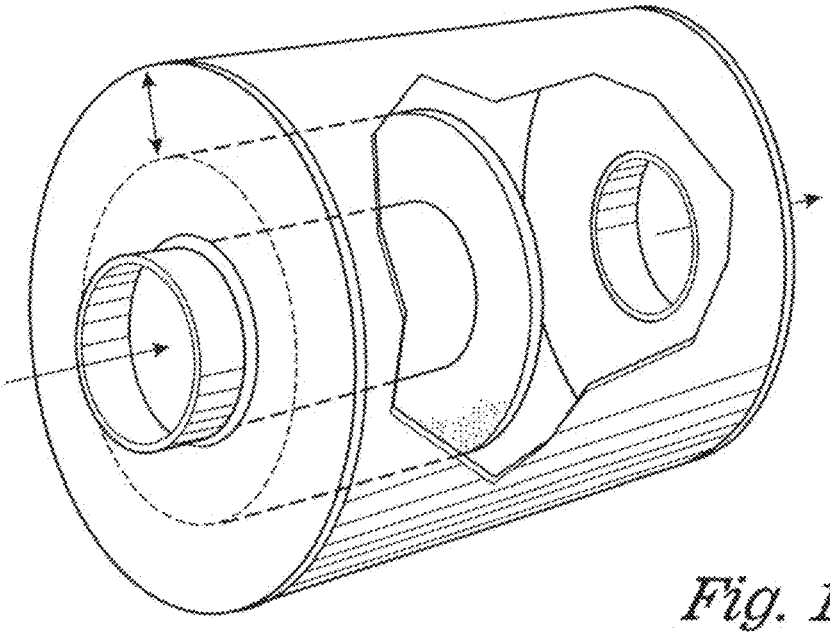
Fig. 1 PRIOR ART
FIG. 1 shows a prior art suppressor construct.
Figure 2:
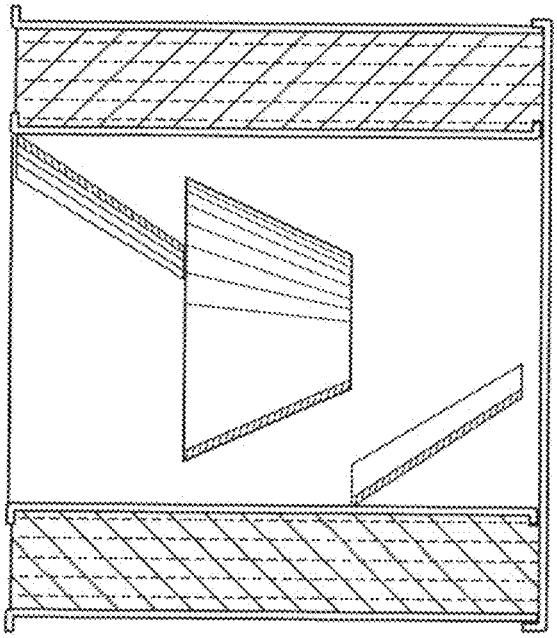
Fig. 2 PRIOR ART
FIG. 2 shows another prior art suppressor construct.
Figure 3:
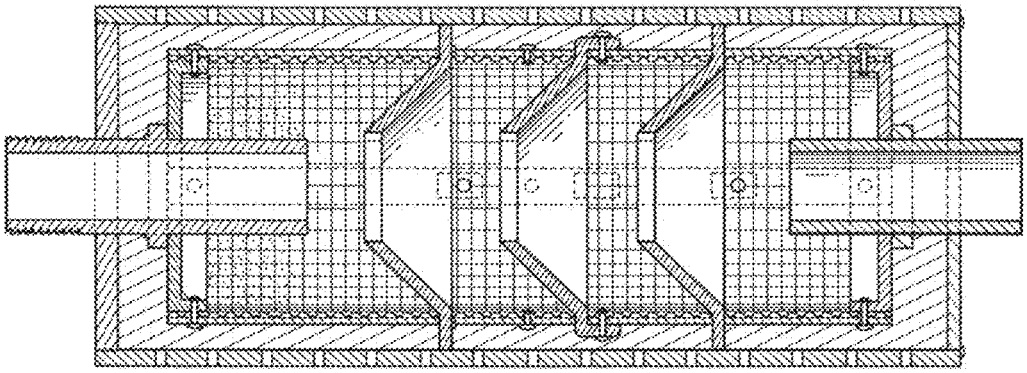
Fig. 3 PRIOR ART
FIG. 3 shows a yet another prior art suppressor construct.
Figure 4:
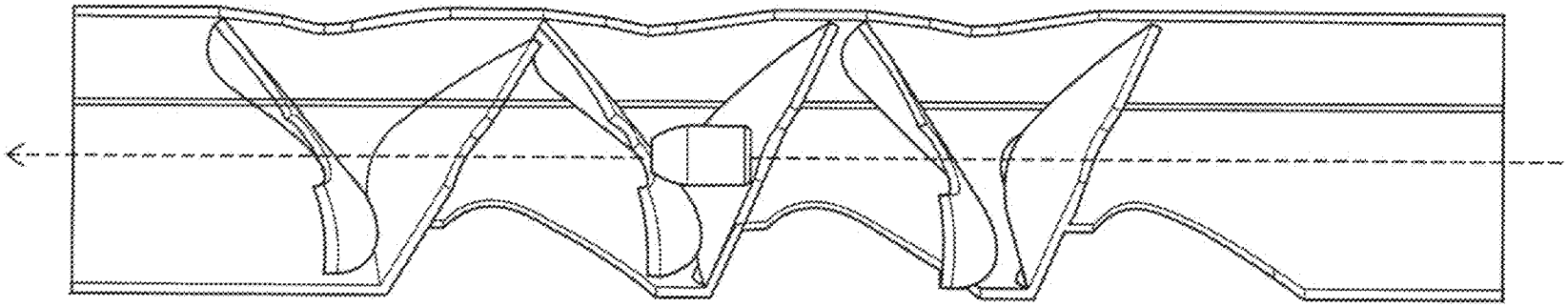
Fig.4 PRIOR ART
FIG. 4 also shows a still further prior art suppressor construct.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Figure 5:
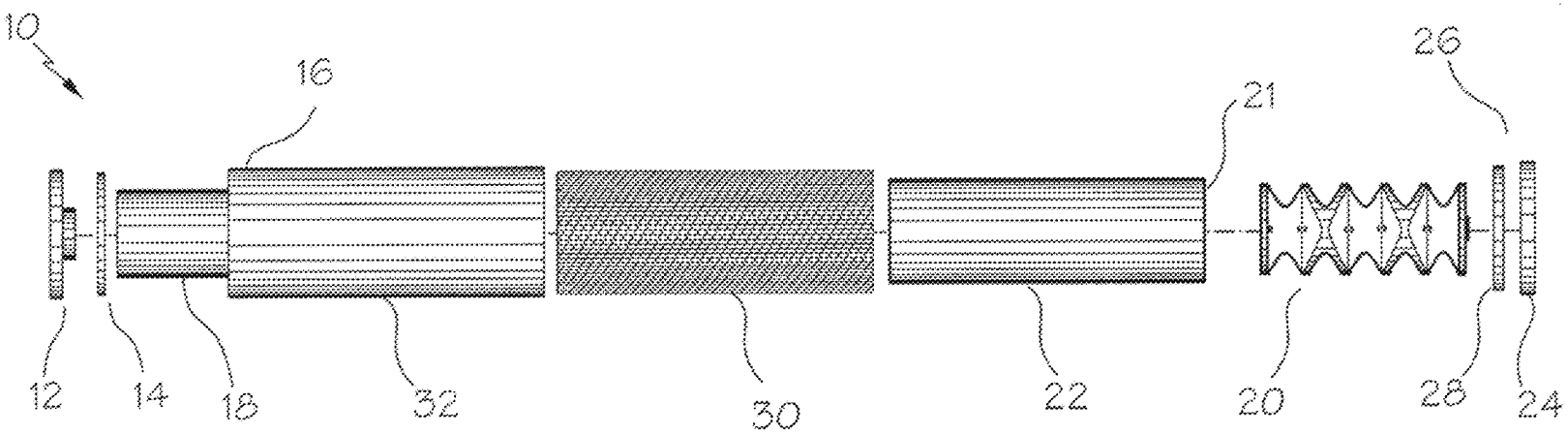
FIG. 5 shows a dissembled suppressor of the current disclosure.

FIG. 5 shows an exploded view of one embodiment of a suppressor 10 of the current disclosure. Suppressor 10 may include a muzzle endcap 12, which in use would be affixed to the muzzle of a rifle, not shown, via threading, welding, adhesives, or other means as known to those of skill in the art. In a preferred embodiment, endcap 12 may be affixed to a rifle via a taper lug lock system as described infra. Suppressor 10 may also include a muzzle end cap insulation disc 14 for insulating proximal end 16 of suppressor 10. Insulation disc 14 may be made from a variety of insulations. In a preferred embodiment, the insulation may be fibrous silica. Further, the insulation may be a flexible ceramic, such as those available from Eurekite. In another embodiment, the insulation may comprise a silica fiber reinforced microporous foam comprised of fumed silica, metal oxides, and reinforcement fibers. In a further embodiment, the foam may be covered by a fabric comprised of the same material as the foam with a greater proportion of reinforcement fibers, such as 5, 10, 15, 20, 25, 30, 35, 40, 45 or 50 or a higher percentage of reinforcement fibers. In a further embodiment, the insulation may be a flexible fabric that covers a condensed powder, both may be formed from alumina-magnesia-carbon flexible ceramic, such as BTU-BLOCK™ available from Morgan Advanced Materials, Windsor, Berkshire, England.

The insulation may also be contained in a vacuum created between inner tube 22 and outer tube 32. The vacuum may range from 20-50 Mbar, more preferably from 30-40 Mbar, in a preferred embodiment, a vacuum of 32 Mbar may be used with the current disclosure. In one embodiment, the vacuum seal pressure may be 0 to 2.0 Torr. In a preferred embodiment, the range is from 0 to 1.0 Torr. In a more preferred embodiment, the vacuum seal pressure may be 0.5 Torr. The vacuum may serve to decrease convective heat transfer. Suppressor 10 may also include inner blast baffle spacer 18. Inner blast baffle spacer 18 serves to properly position main baffle 20 within suppressor 10. Main baffle 20 is located in the main expansion chamber 21. Main expansion chamber 21 serves to rapidly and significantly drop the chamber pressure of the gas exiting the rifle barrel. Main expansion chamber 21 has the most significant impact on decreasing the sound that exits the suppressor. A variety of distances and measurements are possible for suppressor designs, given the myriad of baffle designs in production. For this disclosure, one of the primary design advantages is that this suppressor incorporates include a larger inside diameter than those currently available on the market, for instance a suppressor of the current disclosure may be approximately 2" in diameter as compared to a currently available suppressors that are 1.25" in diameter. The larger diameter of the suppressor drops pressure exponentially, as compared to increasing the suppressor length, which decreases gas pressure linearly. Cylinder pressure is determined in part by the cylinder length and the square of the radius. Making a chamber longer will drop the pressure in a linear manner. Increasing the chamber radius will drop the pressure exponentially. In other words, the larger the diameter of the suppressor, the more significant the pressure drop becomes.

Main expansion chamber 21 drops the chamber pressure up to approximately 60% but other values are considered within the scope of this disclosure, such as 65, 70, 75, 80, and 85 percent. Remaining pressure is further dissipated within the main baffle system. The baffles serve to drop gas pressure. At each baffle, the gas is diverted into the baffle chamber, thus slowing the travel of gas. This, in turn allows the gas to expand in each baffle chamber. This allows the gas pressure to drop as the bullet passes through each chamber.

Suppressor 10 may also include inner tube 22 which surrounds main baffle 20. Exit end cap 24 forms the distal end 26 of suppressor 10 and "caps" distal end 26 of suppressor 10. Suppressor 10 may also include exit end cap insulation disc 28 and insulation tube 30, which circumferentially surrounds inner tube 22 and is positioned between inner tube 22 and outer tube 32. The double-walled construction may also function to protect the inner core against drops and shock damage from impacts, which could potentially damage the suppressor. Outer tube 32 may also be covered by a carbon fiber wrap 300, see FIG. 24. Carbon fiber wrap further insulates the suppressor against conductive and convective heat transfer. This is particular useful in hot weather environments where the surface temperature exceeds 100 degrees Fahrenheit.

Hot weather will increase the ambient surface temperature of the suppressor, which may result in suppressor generated mirage or "heat mirage." Mirage is a naturally occurring optical phenomenon in which light rays are bent to produce a displaced image of distant objects. A mirage is extremely noticeable when observed through optics, such as a spotting or sniper scope, since light rays actually are refracted to form the false image at the shooter's or observer's location.

Cold air is denser than warm air, and therefore has a greater refractive index. As light passes from colder air across a sharp boundary to significantly warmer air, the light rays bend away from the direction of the temperature gradient. When light rays pass from hotter to cooler, they bend toward the direction of the gradient. If the air near the ground is warmer than the air higher up, the light rays bend in a concave, upward trajectory—something commonly seen through rifle optics. In the case where the air is cooler on the ground or near the ground than the air higher up, the light rays curve downward. There are three types of mirage: inferior, superior, and Fata Morgana. Precision shooters typically encounter the inferior mirage.

The inferior mirage is also known as the highway mirage, or desert mirage, and looks as if water or oil is on or near the target. With inferior mirages, the target's image is distorted. It may be vibrating, vertically extended (towering), or horizontally extended (stooping). If there are several temperature layers, several mirages may mix, perhaps causing double images.

Another type of mirage that precision shooters may encounter is known as barrel mirage. Barrel mirage occurs as the rifle barrel heats up, typically when the shooter fires an excess of 10-15+ rounds without a sustained break in-between shots. The barrel mirage will occur faster when the shooter uses a suppressor. The heat rising from the barrel can make the target waver around. Carbon fiber wrap will eliminate this effect.

Figure 6:
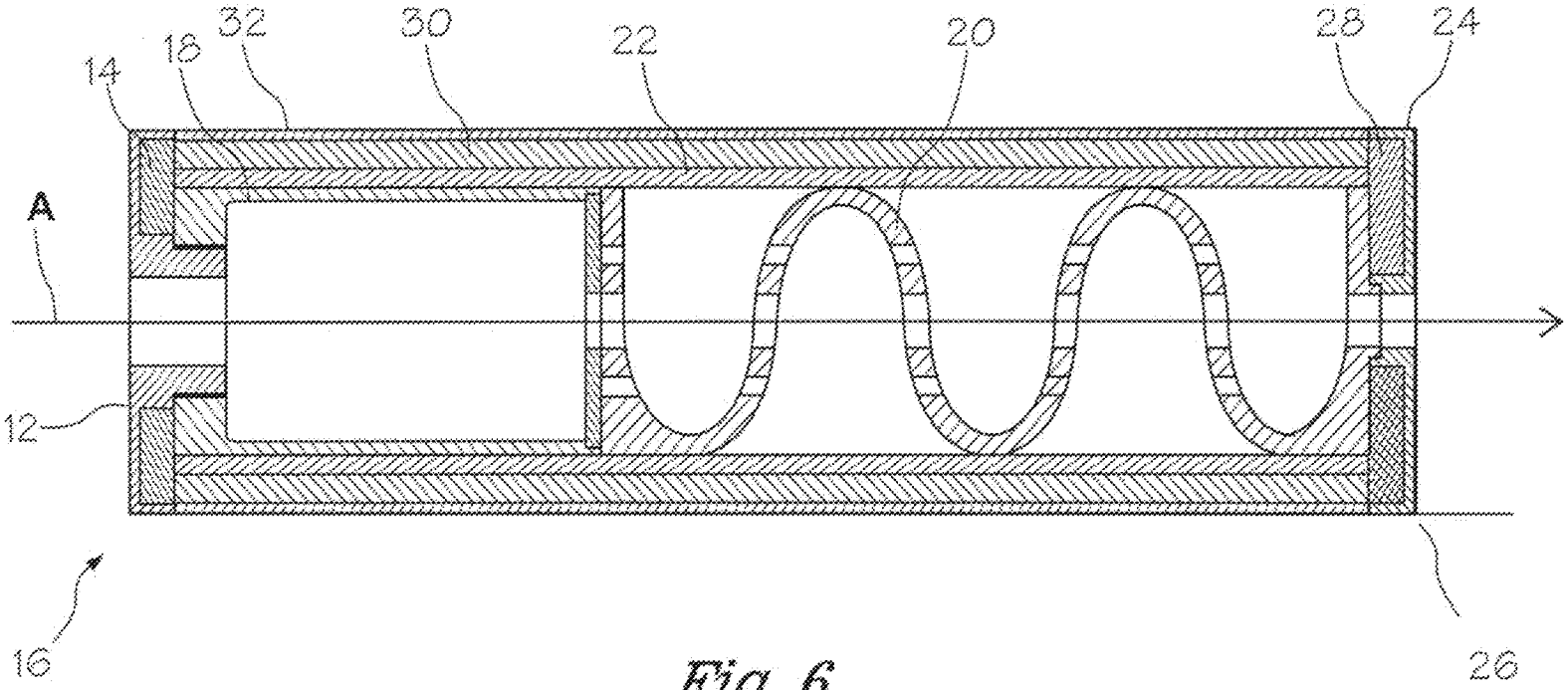
FIG. 6 shows a cross sectional view of a suppressor of the current disclosure.

FIG. 6 shows an assembled, sectional view of suppressor 10 with arrow A representing the path of a bullet, not shown, through suppressor 10 from proximal end 16 until exiting distal end 26.

Figure 7:
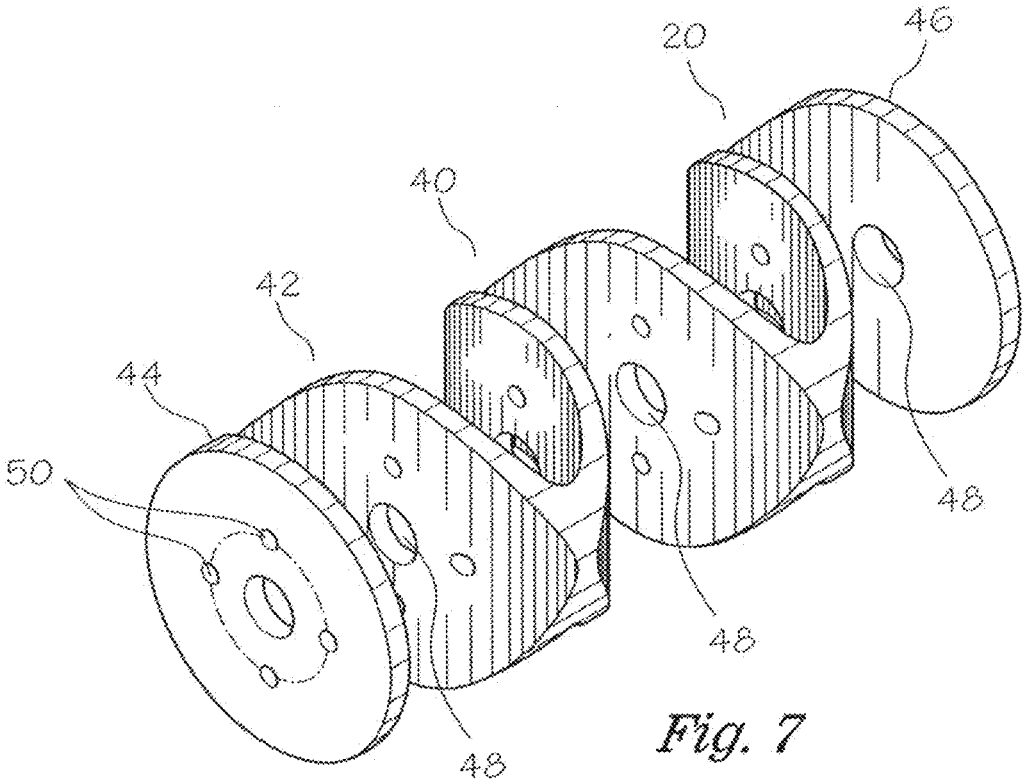
FIG. 7 shows a monocore baffle of the current disclosure.

FIG. 7 shows a perspective view of main baffle 20. In one embodiment, main baffle 20 may comprise a monocore structure 40. In one embodiment, monocore structure 40 may be shaped as a one-piece sinusoidal wave 42 with a flattened first end portion 44 and a flattened second end portion 46. In one embodiment, the sine wave baffle total length is 4.5 inches with each sine wave of the one-piece sinusoidal wave 42 being 1.036 inches long. The sine wave of the one-piece sinusoidal wave is 63 degrees and the width of one-piece sinusoidal wave 42 is 1.5 inches.

Bullet path openings 48 placed throughout the center of sinusoidal wave 42 form a bullet path, see Arrow A of FIG. 6, through the monocore structure 40. Bleed openings 50 serve to bleed the gas contained in each chamber into the adjacent baffle, such as from baffle 43 to baffle 45, etc., further increasing the volume into which the gas expands. This further cools the gas, as well as decreases the contained gas pressure.

Figure 8:
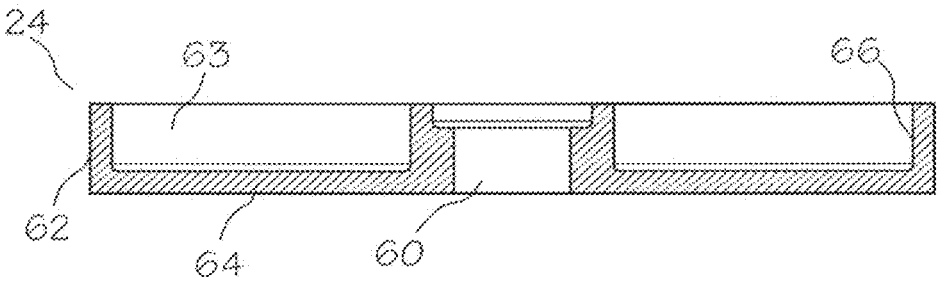
FIG. 8 shows a cross-sectional view of an exit cap of the current disclosure.

FIG. 8 shows a cross-sectional view of exit cap 24, which defines bullet exit 60. Raised, circular exit cap flange 62 is defined in body 64 of exit cap 24 and may be used to affix exit cap 24 to outer tube 32, see FIG. 5, via means such as threads on exit cap inner surface 66 of exit cap flange 62, frictional engagement, welding, etc. In a preferred embodiment, exit cap 24 is affixed to outer tube 32 via means knowns to those in the art. In one instance, exit cap 24 may be affixed to outer tube 32 via welding. Exit cap 24 has a female recess 63 that is tightly sealed onto the "male" rim of outer tube 32. This design creates a seal around the insulation contained within the suppressor so that it is not exposed to any gas pressure resulting from bullet firings. Exposing the insulation to the high pressure and explosive pressure inside the main Suppressor would rapidly deteriorate the integrity of the insulation.

Figure 9A:
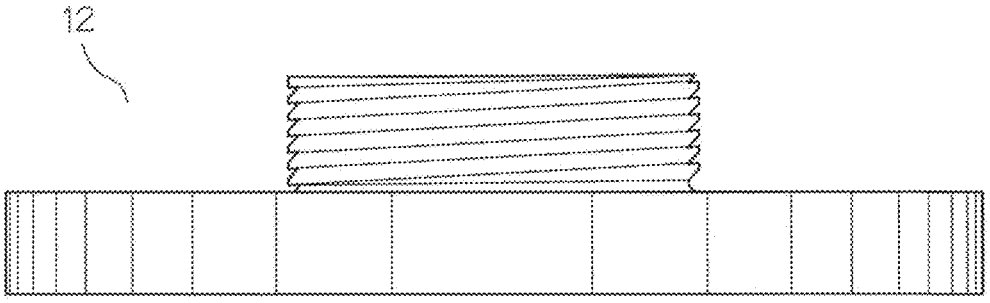
FIG. 9A shows a side view of a muzzle end cap of the current disclosure.
Figure 9B:
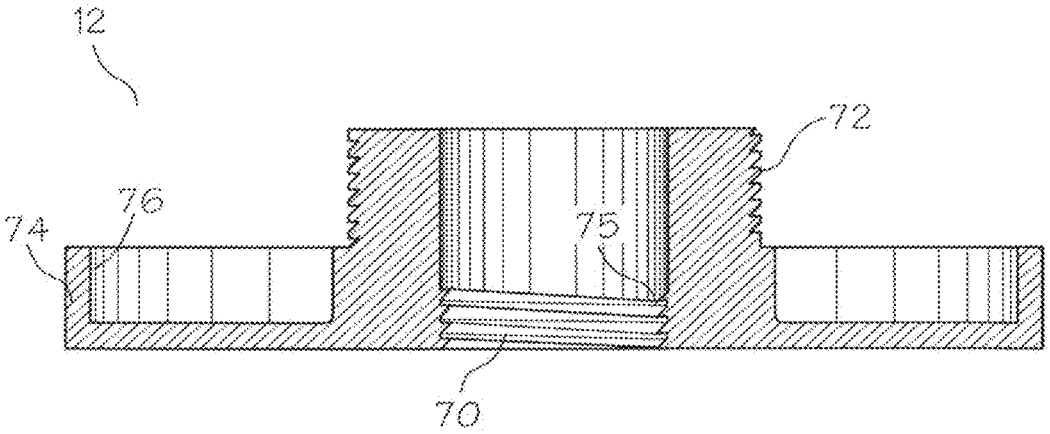
FIG. 9B shows a cross-sectional view of FIG. 9A.

FIG. 9A shows a side view of muzzle end cap 12 and FIG. 9B shows a cross-sectional view of FIG. 9A. Muzzle end cap 12 defines bullet entrance 70. Muzzle end cap 12 may include threaded section 72 for affixing muzzle end cap 12 to inner blast baffle 18, not show, which would include an inner blast baffle engaging surface for threaded section 72. Flange 74 fits over the outer circumference of outer tube 32 and may be affixed to outer tube 32 via threads on muzzle end cap inner surface 76 of muzzle end cap flange 74, frictional engagement, welding, etc. In a preferred embodiment, muzzle endcap 12 may be threaded into inner baffle 18. This results in completely isolating the surrounding insulation from gas pressure. Muzzle end cap 12 may also have external threads 75 in order to thread muzzle end cap 12 onto a threaded end of a rifle barrel, not shown.

Figure 10A:
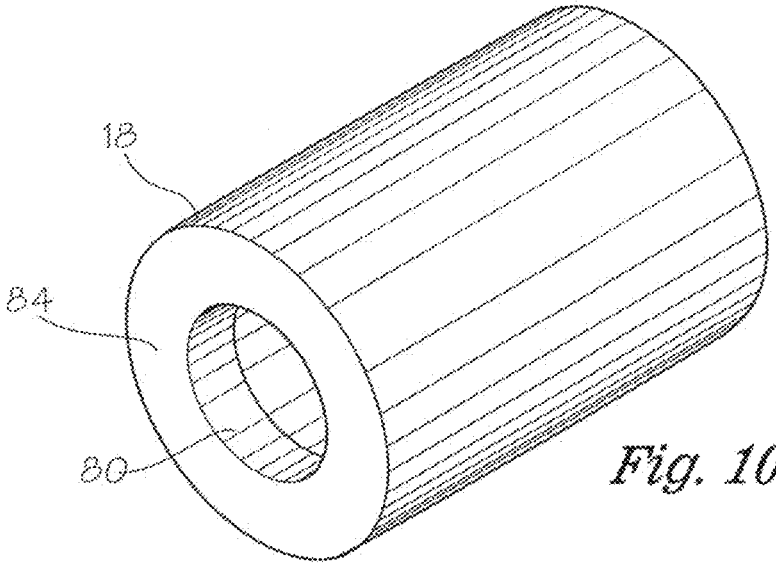
FIG. 10A shows a perspective view of an inner blast baffle spacer of the current disclosure.
Figure 10B:
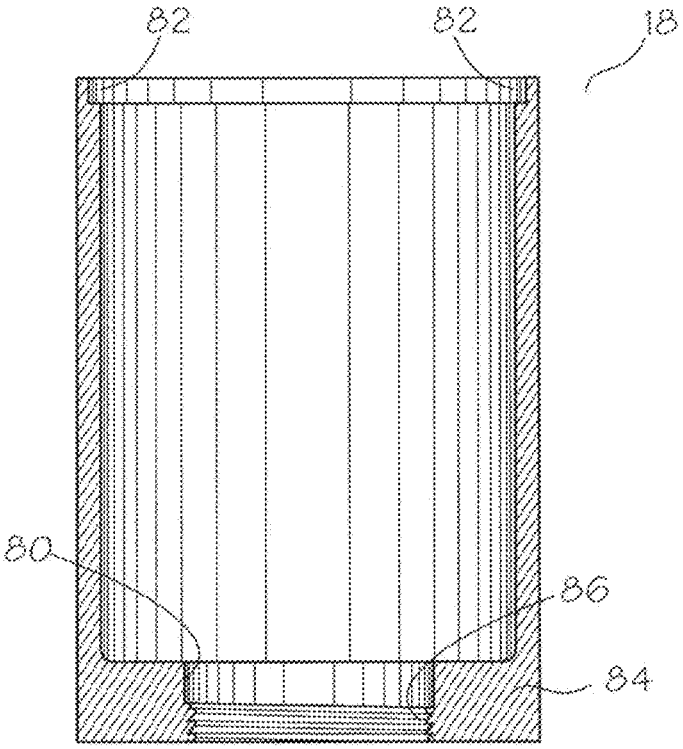
FIG. 10B shows a cross sectional view of an inner blast baffle spacer of the current disclosure.

FIG. 10A shows a perspective view of inner blast baffle spacer 18. FIG. 10B shows a cross sectional view of inner blast baffle spacer 18. Inner blast baffle spacer 18 includes inner blast baffle engaging surface 80 defined within inner blast baffle collar 84. Inner blast baffle engaging surface 80 may include threads or other means known to those of skill in the art for engaging muzzle end cap 12, such as view baffle threads 86 engaging threaded section 72 of muzzle end cap 12. Indents 82 may serve as a ledge for holding an inner blast baffle cap, not shown.

Figure 11A:
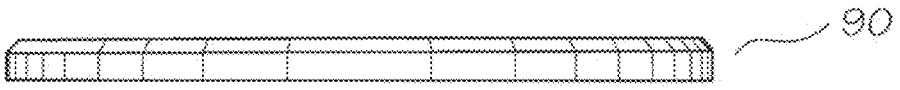
FIG. 11A shows a side view of one embodiment of an inner blast baffle spacer cap of the current disclosure.
Figure 11B:
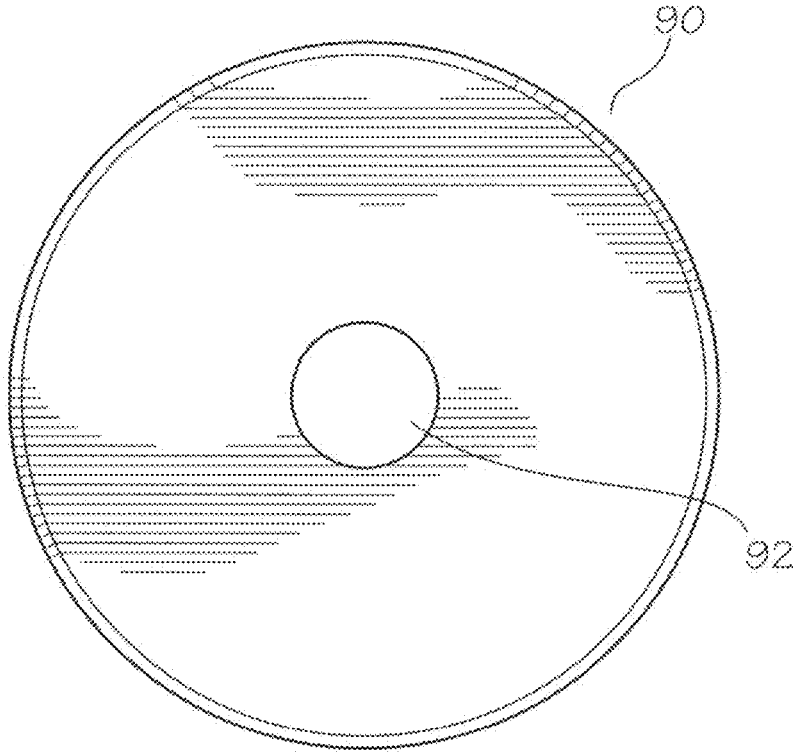
FIG. 11B shows a top down view of an inner blast baffle spacer of the current disclosure.
Figure 12A:
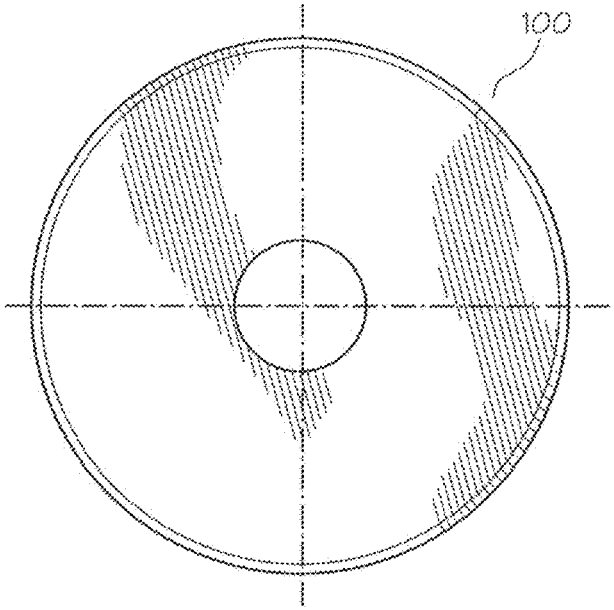
FIG. 12A shows a top down view of one embodiment of an insulation ring of the current disclosure.
Figure 12B:
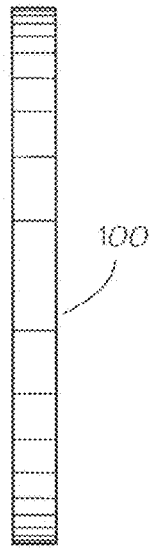
FIG. 12B shows a side view of an insulation ring of the current disclosure.
Figure 13:
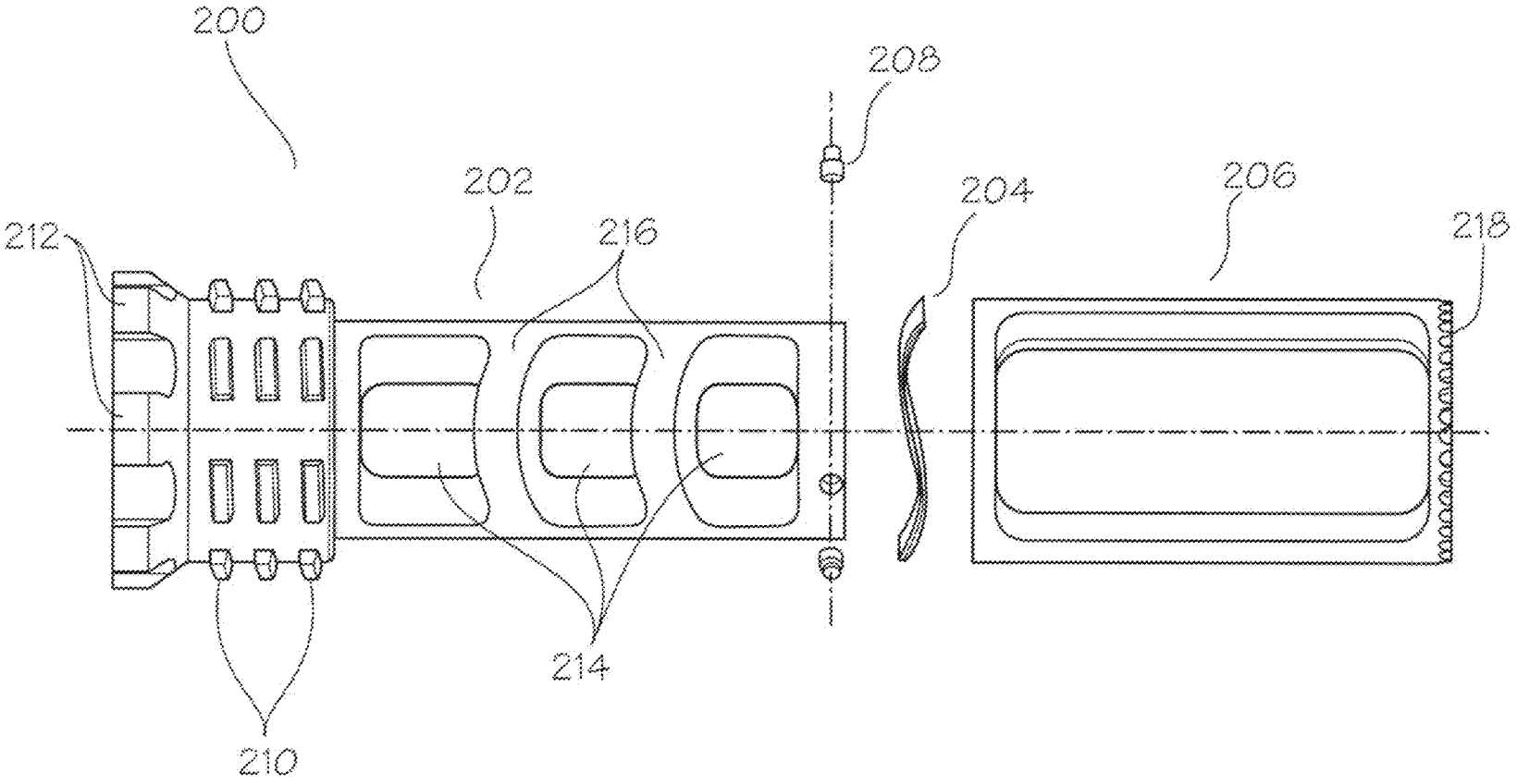
FIG. 13 shows a locking lug system of the current disclosure.

FIG. 11A shows a side view of one embodiment of an inner blast baffle spacer cap 90 and FIG. 11 B shows a top down view of inner blast baffle spacer 90, which defines bullet orifice 92. Inner blast baffle spacer 90 creates a boundary between the end of main baffle 20 and exit endcap 24. FIG. 12A shows a top down view of one embodiment of an insulation ring 100 that may be used for form muzzle end cap insulation 14 and/or end cap insulation disc 28. FIG. 12B shows a side view of insulation ring 100. The endcap insulation dimensions accommodate different bore diameters between each end cap. The bore diameter of muzzle endcap 12 is larger to accommodate threading a rifle barrel. The bore of exit endcap 24 is smaller as it may be identical in size to the bore measurement of the suppressor.

In a further embodiment, a locking lug system 200 for a muzzle brake is disclosed. A muzzle brake, or recoil compensator, is a device that connects to the muzzle of a firearm that redirects propellant gases to counter recoil and unwanted rising of the gun barrel during rapid fire.

Besides reducing felt recoil, one of the primary advantages of a muzzle brake is the reduction of muzzle rise. This lets a shooter realign a weapon's sights more quickly. Muzzle rise can theoretically be eliminated by an efficient design. Because the rifle moves rearward less, the shooter has little for which to compensate. Muzzle brakes benefit rapid-fire, fully automatic fire, and large-bore hunting rifles. They are also common on small-bore vermin rifles, where reducing the muzzle rise lets the shooter see the bullet impact through a telescopic sight. A reduction in recoil also reduces the chance of undesired (painful) contacts between the shooter's head and the ocular of a telescopic sight or other aiming components that must be positioned near the shooter's eye (often referred to as "scope eye"). Another advantage of a muzzle brake is a reduction of recoil fatigue during extended practice sessions, enabling the shooter to consecutively fire more rounds accurately. Further, flinch (involuntary pre-trigger-release anxiety behavior resulting in inaccurate aiming and shooting) caused by excessive recoil may be reduced or eliminated.

The muzzle brake of the current disclosure is unique in at least two ways. The locking system secures a suppressor to the brake using a three point locking system. The locking system itself is a first of its kind. The muzzle brake also has a short throw, quick detach locking system that permits rapid installation and removal of a suppressor. When the suppressor is mounted onto the brake, there is no movement between the suppressor and the brake. The locking system is secure, so that is virtually eliminates the chance of the suppressor becoming loose. Suppressor loosening is a well-recognized problem with standard thread on mounting.

The first locking mechanism consists of a slotted Acme thread system. The suppressor, with a similar slotted thread attachment, permits the suppressor to slide onto the brake via the slots. When the suppressor is twisted, the threads engage and compress the suppressor onto the second locking part, the Morse taper. This taper is compressed onto the facing taper of the brake. This ensures a reproducible, concentric seating of the suppressor onto the brake. This optimizes the linear alignment of the suppressor to the barrel. The third locking system is spring loaded de-rotation tab that engages the back of the suppressor to the rear grooved section of the brake. Once the suppressor is secured to the brake, the tab on the back face of the suppressor is released to engage into the slot in the brake. This eliminates any rotation of the suppressor once engaged.

The second function is a tunable muzzle brake. The purpose of the tunable brake is to precisely modify the barrel harmonics using an adjustable rotating sleeve. The sleeve can be sequentially rotated which gradually covers the side vents of the brake. By closing down the openings, the escaping amount of gas from the side vents is decreased. By controlling the amount of escaping gas, the barrel vibration generated by the escaping gas is changed. This control of the barrel vibration can result in two favorable effects. The first benefit that altering the barrel harmonics can create is an improvement in accuracy. The sequential closing down of the side vents can result in a consistent harmonic vibration that results in each bullet that exits the barrel, does so at the same position of the barrel's vibration cycle. Without a method to control the amount of barrel vibration after each round is fired, the bullet that exits the barrel does so at random positions in the vibration cycle. This can result in suboptimal accuracy. Controlling this variable using the tunable brake, can enhance barrel accuracy.

Many methods to tune the barrel harmonics exist. For the current disclosure, the sleeve is gradually screwed down over the muzzle, thus closing the vent holes in a precise manner. This process is continued between each shot fired until the shot group closes down to the most precise level obtainable with this system in place.

The second benefit that this tunable muzzle brake provides is to minimize the zero shift when a suppressor is mounted onto to a rifle barrel. When a suppressor is mounted to a rifle barrel, the added mass will alter the barrel harmonics. As a result, the point of impact shifts after a round is fired through the suppressed barrel. Several factors that alter the zero shift also include the weight of the suppressor. This factor cannot be completely eliminated by the tunable brake, but it can assist in minimizing this negative effect by adjusting the barrel harmonic vibration.

Locking lug system 200 may include a muzzle brake 202, a triple wave washer 204, a muzzle brake cover 206, as well as locking pins 208 to affix muzzle brake cover 206 to muzzle brake 202. Muzzle brake 202 may include threads 210 which attach locking lug system 200 to a muzzle end cap (See FIG. 14). Locking lug system 200 may be made from metals, plastics, synthetics, etc. as known to those of skill in the art. Muzzle brake 202 may include threads 210 as well as alignment blocks 212 for engagement with lug muzzle end cap 230, see FIG. 14. Threads 210 may be continuous or discontinuous. Threads 210 may be arranged in columns 211, separated by slots 213 arranged lengthwise. Each slot 213 may be as wide as the threaded columns 211. The suppressor base plate 230 contains an identical slotted thread design. Slots 213 on the muzzle brake allow threads on the suppressor to slide down onto the tapered base. Upon twisting the suppressor, the threads on the suppressor base engage threads 210 on the muzzle brake 202. This compresses the suppressor down onto the tapered base. This design results in a solid, short throw quick attach/detach locking mechanism which virtually eliminates any motion between the suppressor and muzzle brake. The design effectively resists vibration induced loosening. To date, no other suppressor quick detach system utilizes this design.

Alignment blocks 212 may serve to mate with the interior of lug muzzle end cap 230 to guide muzzle brake 202 into its final position with lug muzzle end cap 230. Muzzle brake 202 may also define vents 214 within muzzle brake body 216, vents 214 may be formed from various shapes with muzzle brake ribs 218 helping define vents 214 within muzzle brake body 216. While three vents 214 are shown defined within muzzle brake body 216, more or less vents are considered within the scope of this disclosure. Locking lug system 200 may also include triple wave washer 204. Triple wave washer 204 may be compressible. Being compressible permits the muzzle brake cover 206 to be pulled rearward. This disengages muzzle brake cover 206 from locking pins 208 that hold muzzle brake cover 206 in place once adjusted. Once muzzle brake cover 206 is released, triple wave washer 204 pushes muzzle brake cover 206 against locking pins 208 and maintains muzzle brake cover 206 in its adjusted position. Muzzle brake cover 206 may include projections 218 which engage with locking pins 208 to prevent movement of muzzle brake cover 206.

Figure 14:
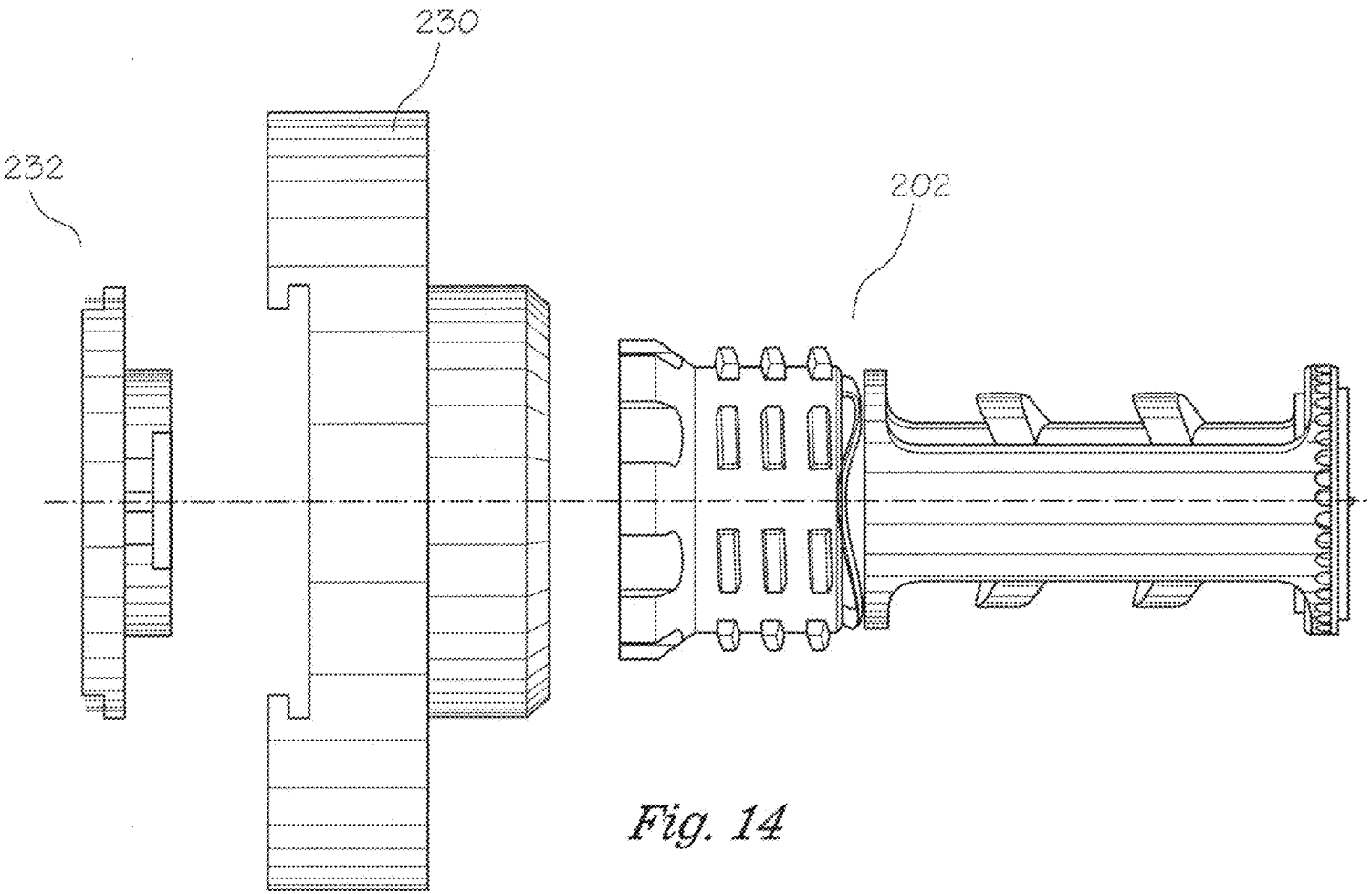
FIG. 14 shows a disassembled view of a muzzle brake, lug muzzle end cap, and a lock latch plate of the current disclosure.
Figure 15:
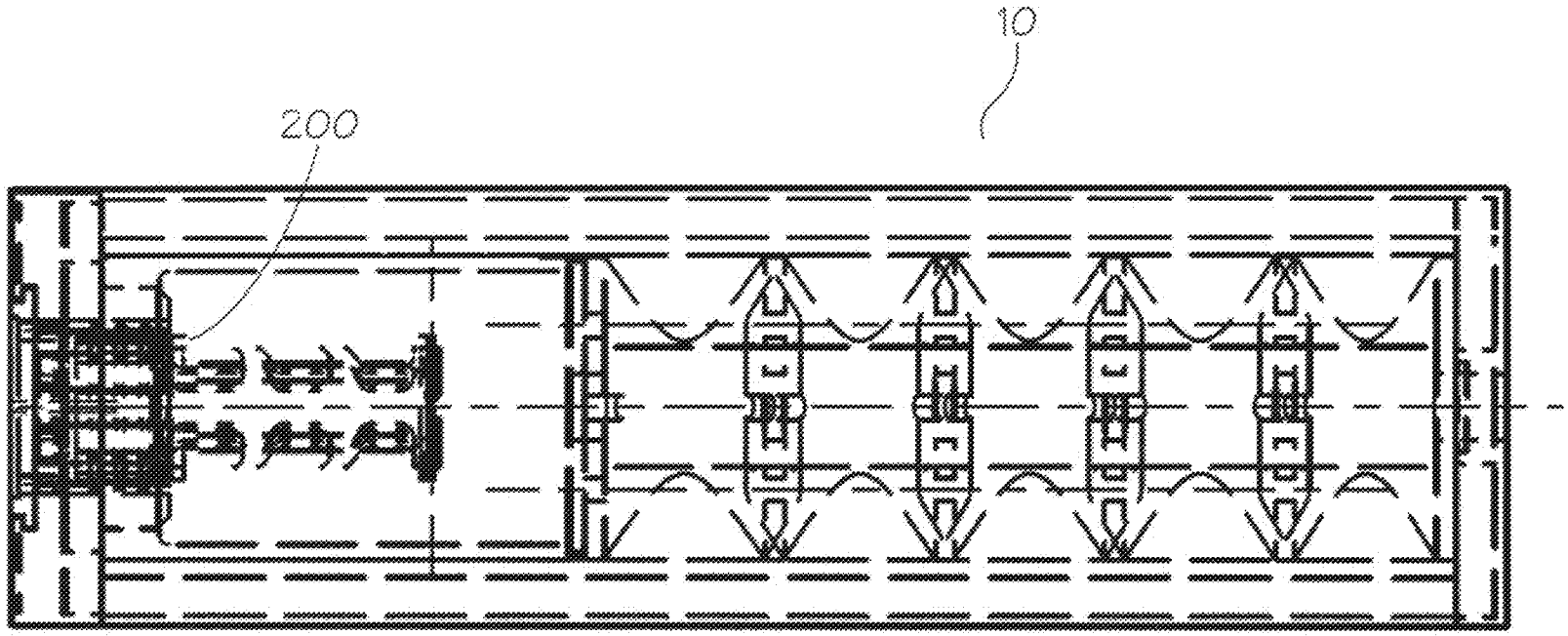
FIG. 15 shows a cross-sectional view of a locking lug systems of the current disclosure integrally associated with a suppressor of the current disclosure.

With respect to FIG. 14, muzzle brake 202 may connect with lug muzzle end cap 230 which may engage with lock latch plate 232. Locking lug system 200 may be free standing and simply attached to a muzzle of a firearm, not shown, or may be incorporated integrally a suppressor 10 of the current disclosure, as shown by FIG. 15.

Figure 16A:
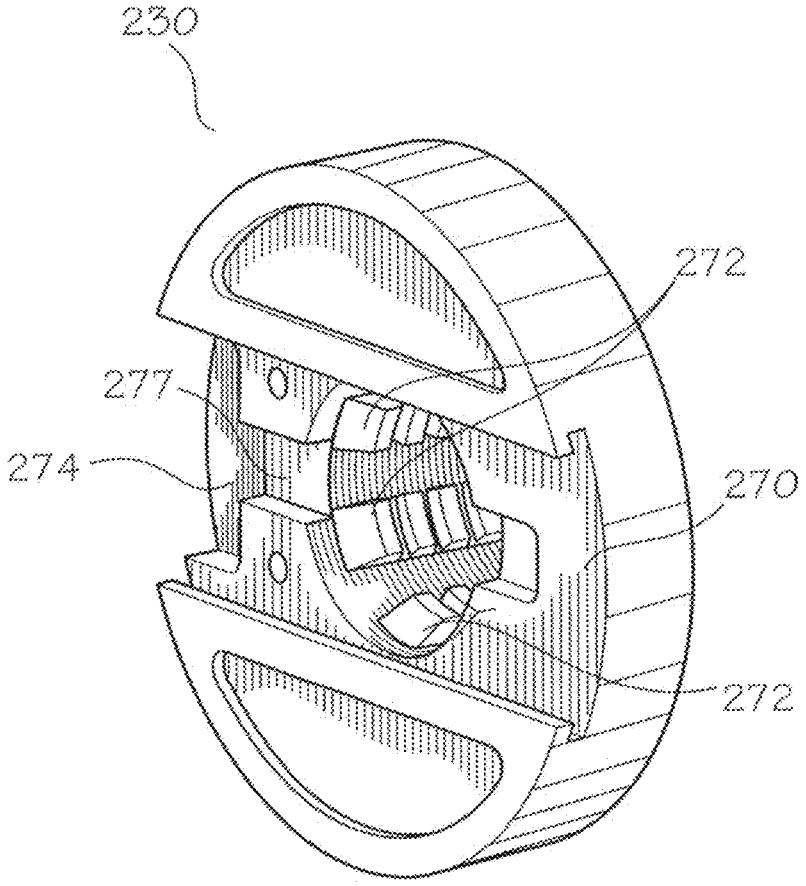
FIG. 16A shows a perspective view of a lug muzzle end cap of the current disclosure.
Figure 16B:
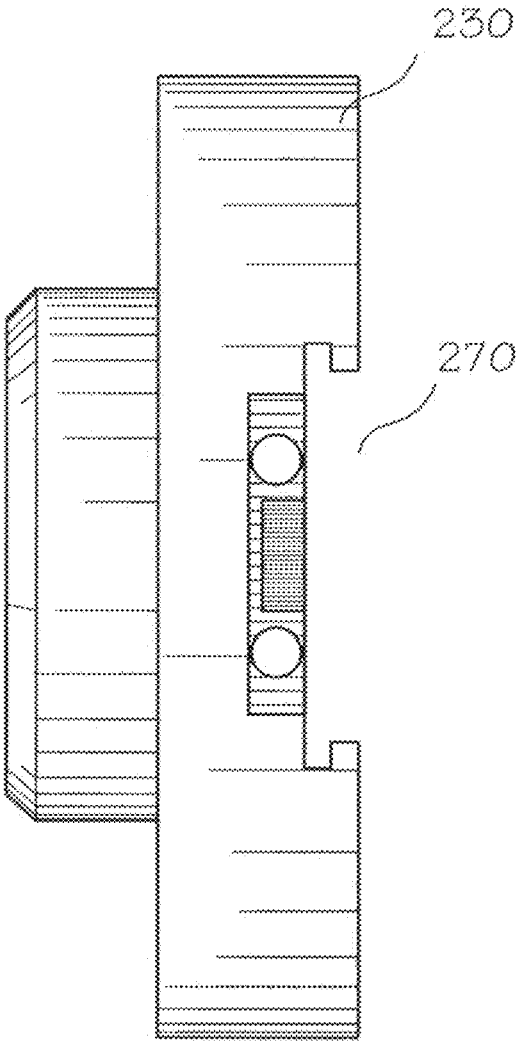
FIG. 16B shows a side view of a lug muzzle end cap of the current disclosure.
Figure 16C:
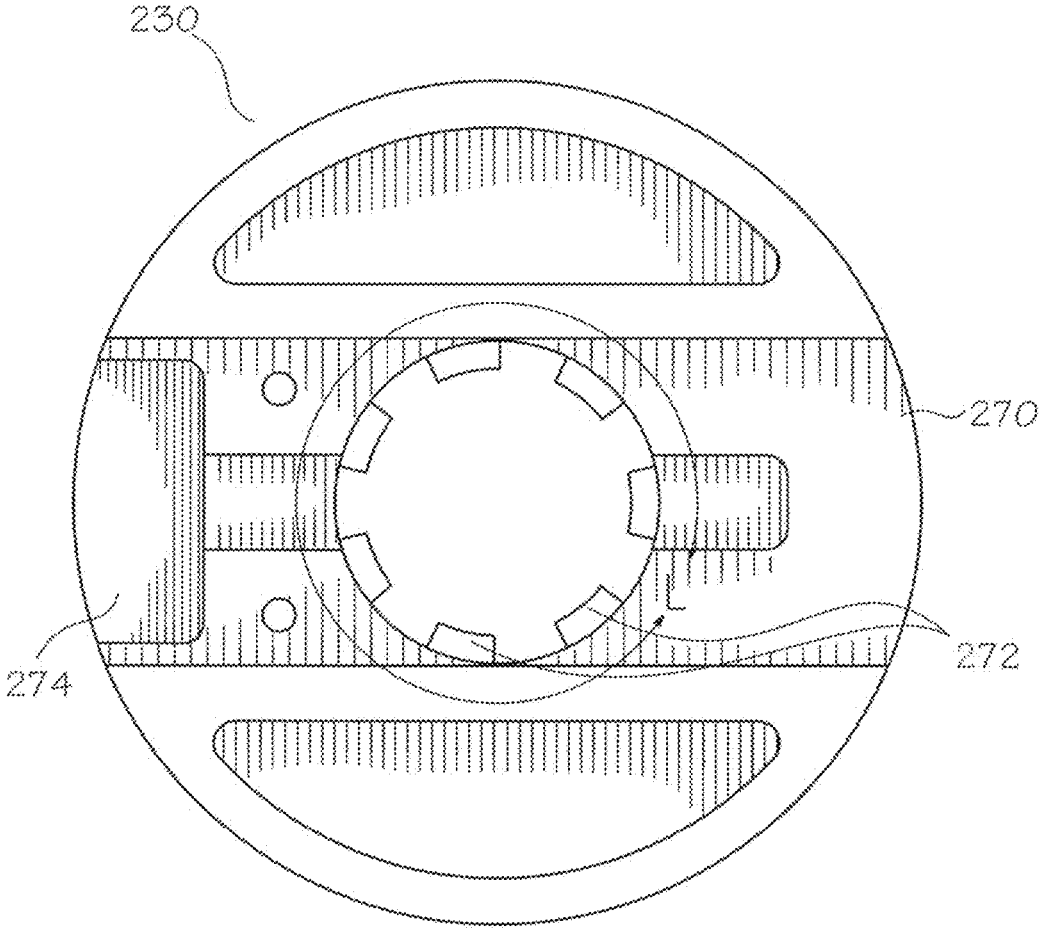
FIG. 16C shows a top down view of a lug muzzle end cap of the current disclosure.
Figure 16D:
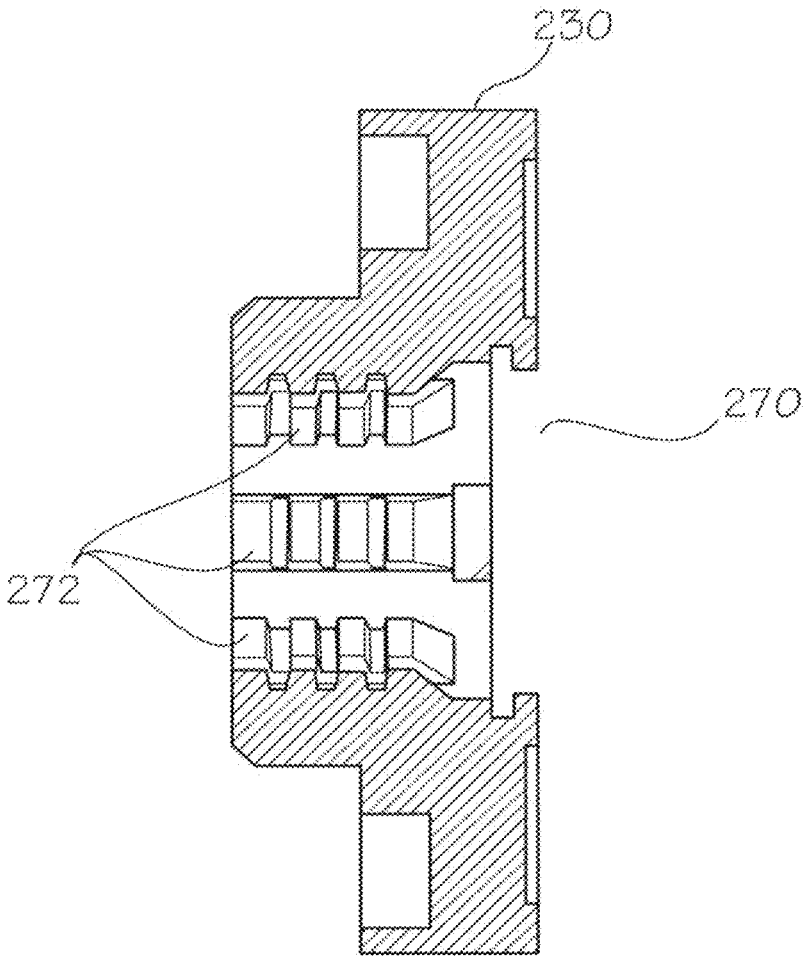
FIG. 16D shows a cross sectional view of a lug muzzle end cap of the current disclosure.
Figure 16E:
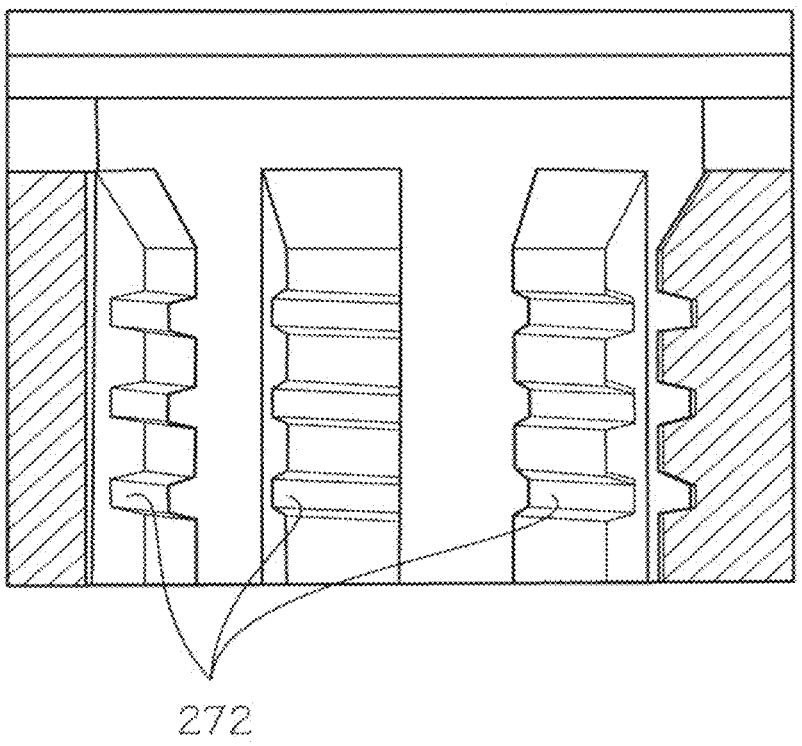
FIG. 16E shows a close-up, cross sectional view of the interior of a lug muzzle end cap of the current disclosure.

FIGS. 16A through 16E show various perspectives of muzzle end cap 230. As FIG. 16A shows, muzzle end cap 230 has an engagement slot 270 for receiving lock latch plate 232, not shown. In addition, muzzle end cap 230 may have engaging threads 272 for engaging threads 210 on muzzle brake 202, not shown, and securing muzzle end cap 230 and muzzle brake 202 together. Muzzle end cap 230 may include a stop gap 274 for halting movement of lock latch plate 232 within engagement slot 270. Lock latch plate 232 slides within engagement slot 270 to lock muzzle brake 202 into engagement with muzzle end cap 230 once muzzle brake 202 is fully threaded into muzzle end cap 230.

Figure 17A:
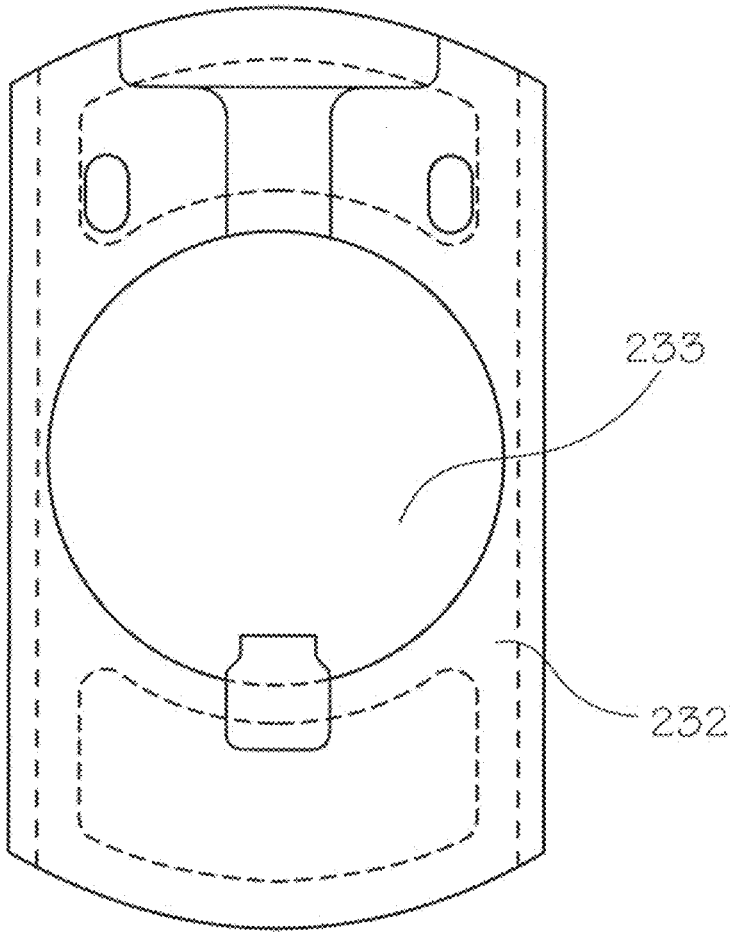
FIG. 17A shows a top down view of a lock latch plate of the current disclosure.
Figure 17B:
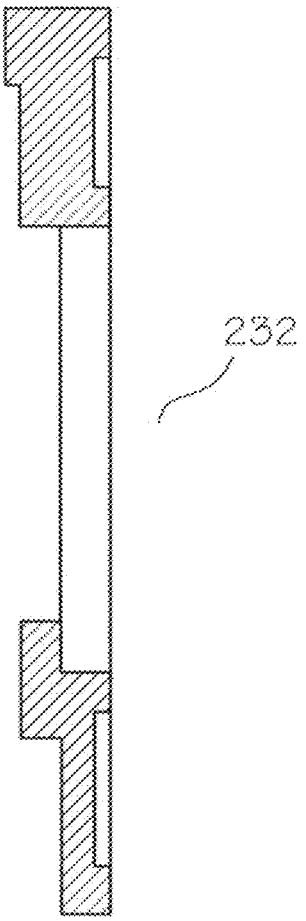
FIG. 17B shows a side view of a lock latch plate of the current disclosure.
Figure 17C:
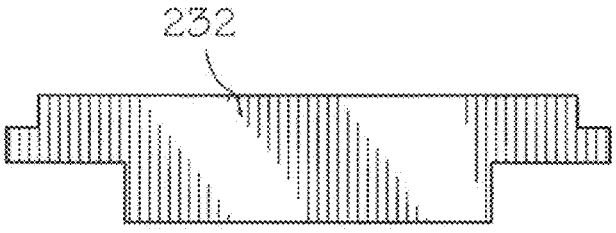
FIG. 17C shows an end-on view of a lock latch plate of the current disclosure.
Figure 17D:
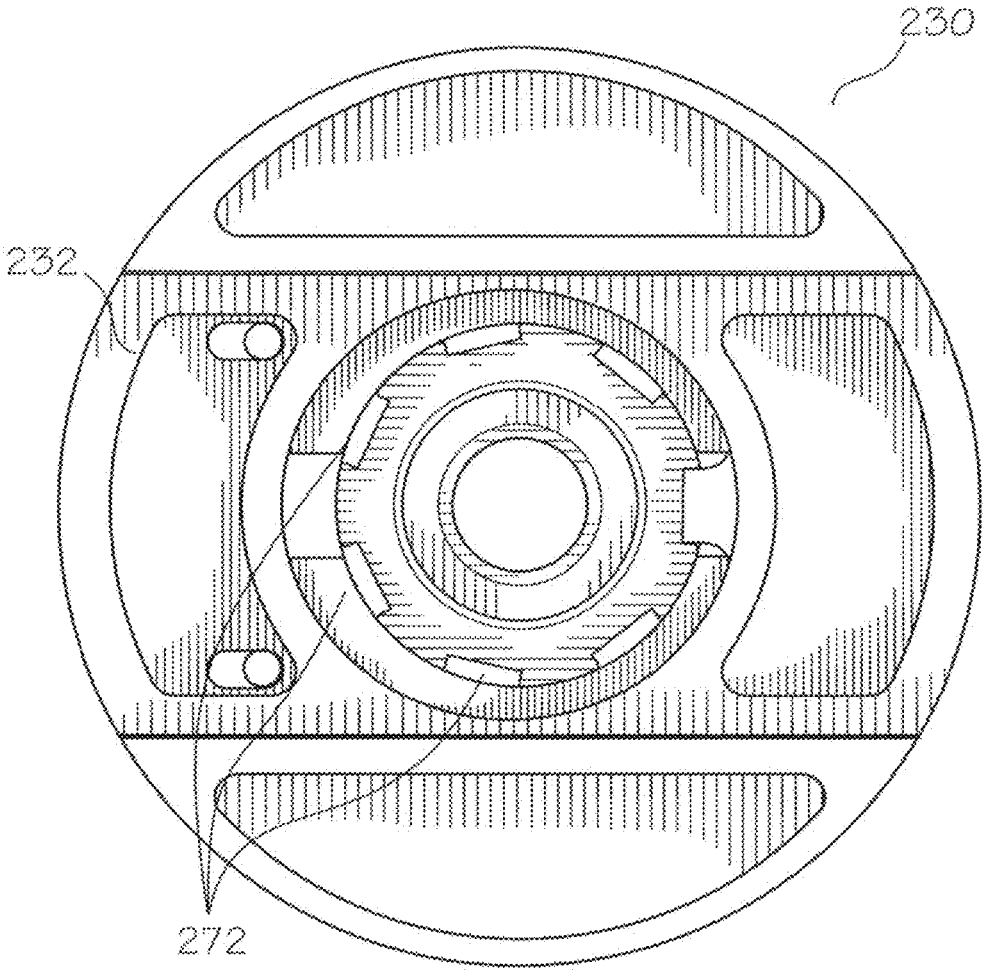
FIG. 17D shows one embodiment of a lock latch plate of the current disclosure in a closed or locked configuration.
Figure 17E:
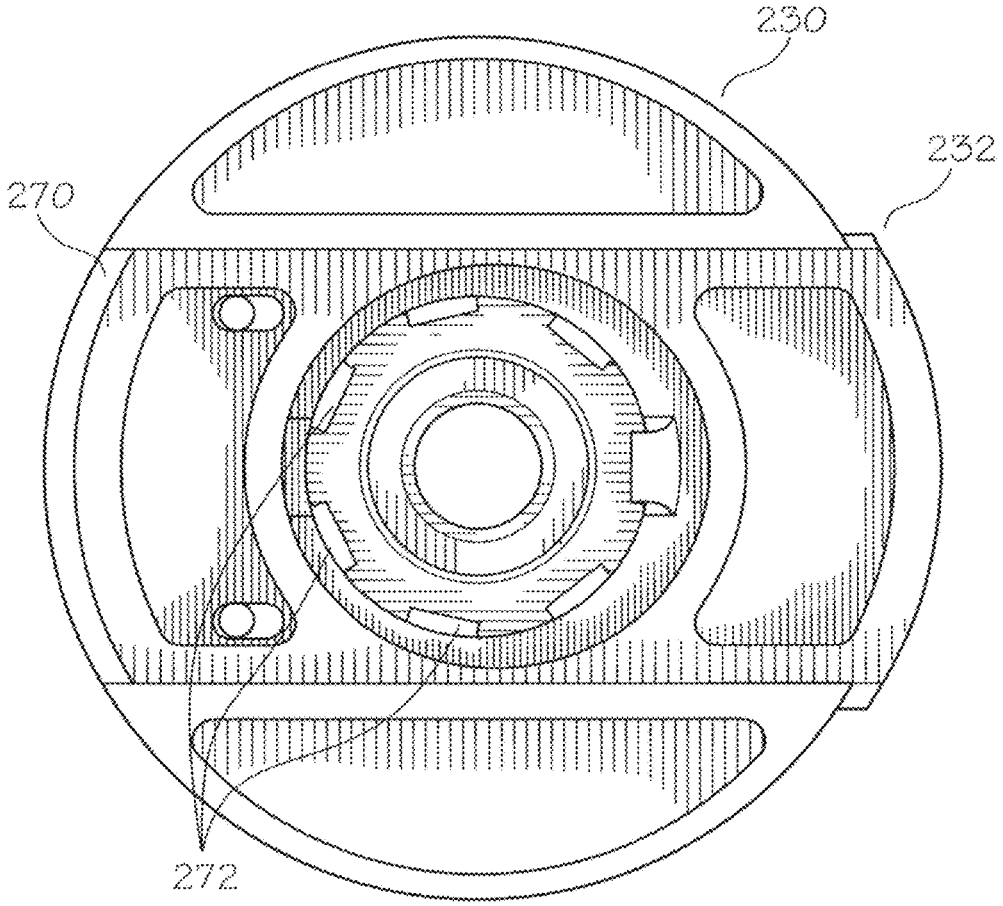
FIG. 17E shows one embodiment of a lock latch plate in an open or unlocked configuration with the lock latch plate extended partially beyond the engagement slot.

FIGS. 17A through 17E show differing views of lock latch plate 232. Once a suppressor is screwed down onto muzzle brake 202, lock latch plate 232, which may be spring biased, may be pressed, thus moving it with respect to muzzle end cap 230, to push the rear locking tab 233 open while the suppressor is mounted, when lock latch plate 232 is then released, this redeploys locking tab 233 into the slot 277 on muzzle end cap 230, see FIG. 16A. Thus, lock latch plate 232 functions as a derotation device, further ensuring the rigid fixation of a suppressor to the muzzle brake is solidly maintained. FIG. 17D shows lock latch plate 232 in a closed or locked configuration with lock latch plate 232 fully located within engagement slot 270. FIG. 17E shows lock latch plate 232 in an open or unlocked configuration with lock latch plate 232 extended partially beyond engagement slot 270. The Evolution suppressor had a maximum temperature of 262 degrees after 150 rounds of rapid fire.

The suppressor of the current disclosure has undergone field testing. Three experiments were conducted to inspect the heat generation during live fire of the suppressor with and without insulation. Sound suppressors create large amounts of heat while controlling hot expanding gasses produced by the burning propellant exiting the muzzle. Accordingly, microporous insulation, WDS LambdaFlex, was used to try to control the surface temperature of the sound suppressor during operation. Surface temperature is important for operator safety as well as reducing the "mirage effect" when using magnified optics. Three samples were tested: (1) suppressor with no insulation; (2) suppressor with WDS LambdaFlex in a foil wrap; and (3) suppressor with WDS LambdaFlex in a notebook paper wrap.

Figure 18:
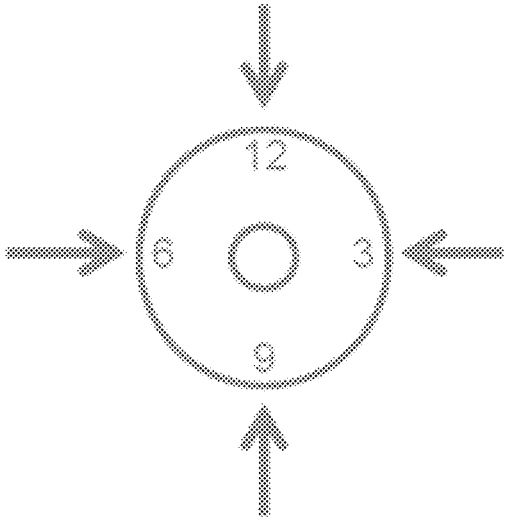
FIG. 18 shows the locations where infrared scans were taken from a suppressor of the current disclosure during field testing.

The test procedure involved performing infrared scans at four (4) locations, as shown by FIG. 18, prior to firing. Twenty (20) rounds are then fired through the suppressor at a rate of approximately one (1) round per second. Additional infrared scans are then performed immediately after firing ceases as the locations marked on FIG. 18. This procedure is continued until a total of sixty (60) rounds have been shot through the suppressor. An Infratec VarioCAM HR camera was used to conduct the infrared measurements. The camera's thermal resolution is ±0.03K with a temperature range of −40° C. to 1200° C. (−40° F. to 2,192° F.). The camera takes infrared and visual images at the same time for comparative purposes and utilized IRBIS 3 software to analyze both infrared and visual images for report assembly.

Figure 19:
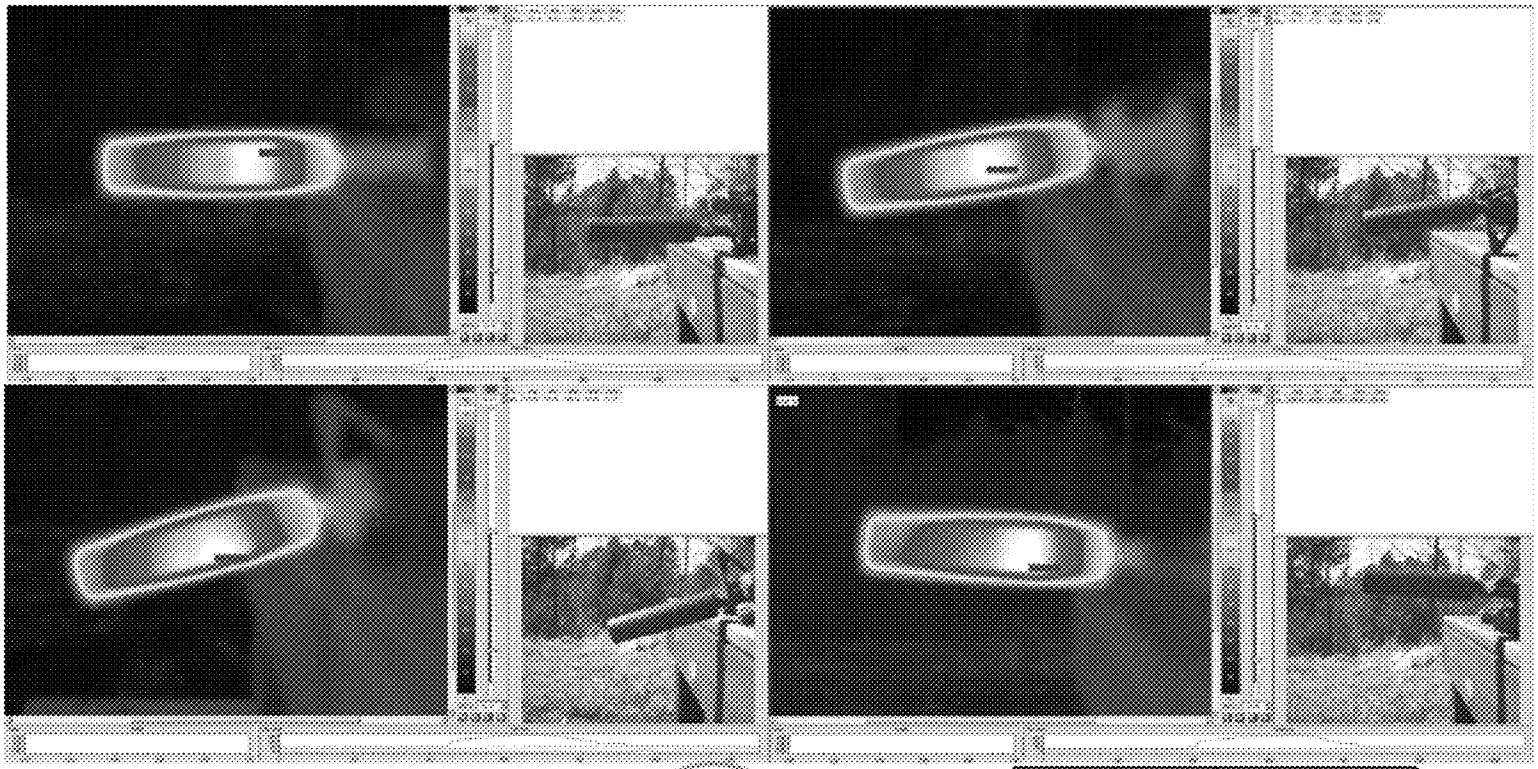
FIG. 19 shows a picture of thermal images of a suppressor without insulation after twenty (20) rounds have been fired.
Figure 20:
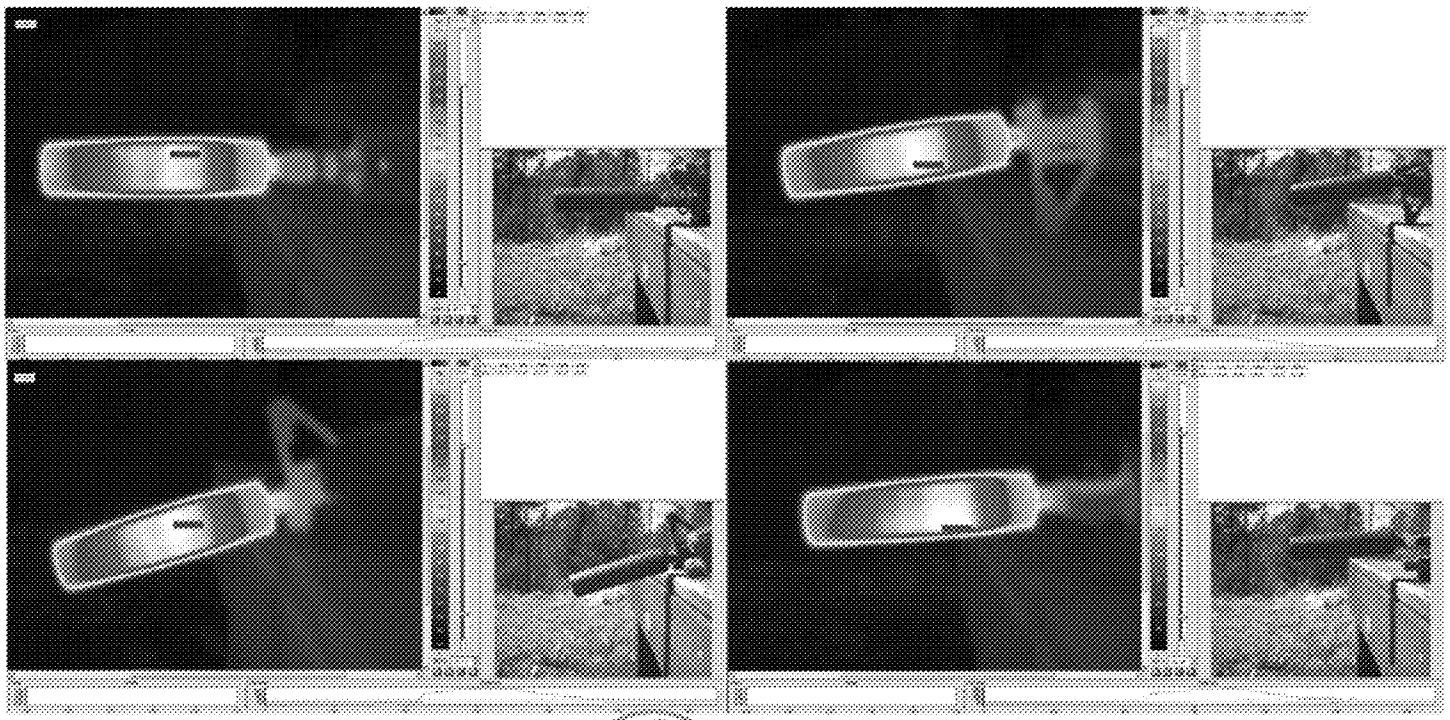
FIG. 20 shows a suppressor without insulation after forty (40) rounds have been fired.

The testing weapon was a 10.5" barrel AR-15. FIG. 19 shows a picture of thermal images of a suppressor without insulation after twenty (20) rounds have been fired. FIG. 20 shows a suppressor without insulation after forty (40) rounds have been fired. FIG. 21 shows a suppressor without insulation after sixty (60) rounds have been fired. FIG. 22 shows the average measurements taken in a chart form. When a carbon fiber wrap is used, the suppressor will only raise approximately 10 degrees in temperature rather than the expected 200+ degrees of a currently available suppressor. In one embodiment, the wrap is a polyacrylonitrile carbon fiber wrap.

The results of the experiment showed that surface temperature is lowered drastically with the addition of 7 mm of LambdaFlex Super on the outside of the suppressor. Foil reflectivity/emissivity made IR scan difficult. Using paper instead of foil as a cover, IR scans were more conclusive. Averages results are shown in FIG. 22 as a comparison chart. In conclusion, the experimental results were that the surface temperature in both insulation tests was safe to touch after firing 60 rounds. Paper cover gave a much better IR scan than the foil cover. Mirage effect was not noticeable in either test after firing 60 rounds.

Comparative testing of a suppressor of the current disclosure was also conducted. Testing comprised a 150 round test, using a 10.5" Barrel AR-15, with shots fired at a rate of approximately 1 shot per 2 seconds. Images were taken at approximately 30 second intervals. The goal was to not exceed 160° F. during the test. Post-test cool down images were taken at 2 minutes post-test, 5 minutes post-test, 10 minutes post-test, 15 minutes post-test, and 20 minutes post-test. Testing conditions were: 90° F. Ambient Temperature, 70% Relative Humidity, 0.85 Emissivity, IR Scans taken from ~2.5 meters away using a JenoptikVarioCAM-HiResIR Camera and employing Irbis3 Software.

Figure 23:
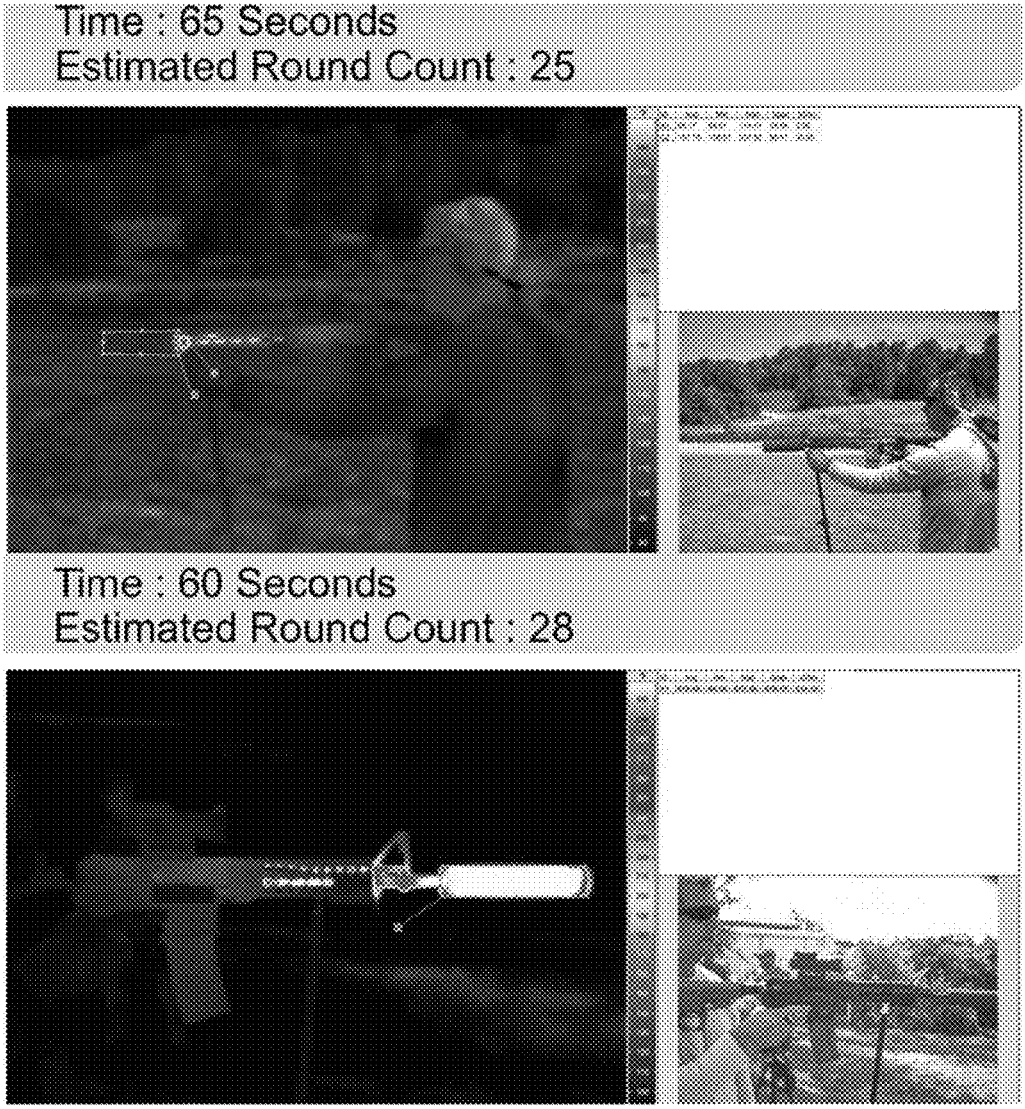
FIG. 23 shows the heat signature of a suppressor of the current disclosure after 65 seconds of fire expending firing 25 rounds.
Figure 24:
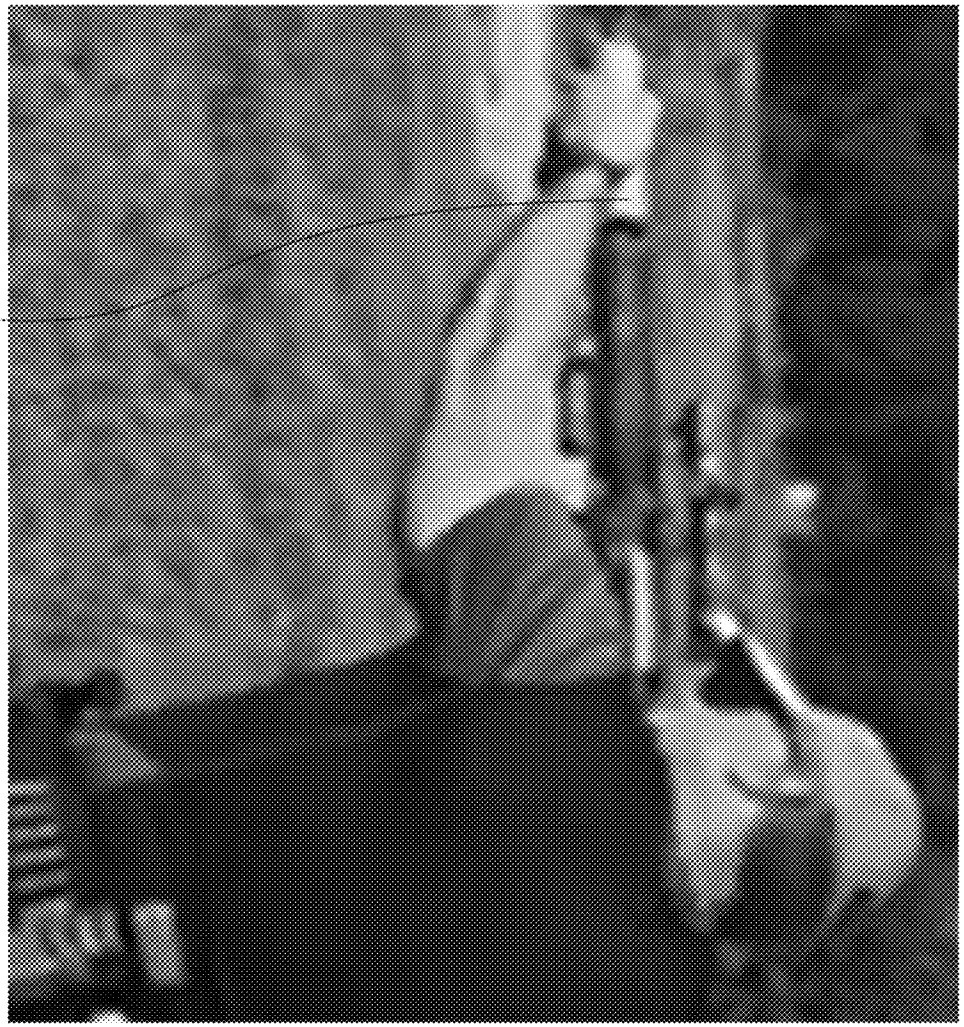
FIG. 24 shows a screen shot of a video wherein a user is holding a suppressor of the current disclosure while firing.
Figure 25:
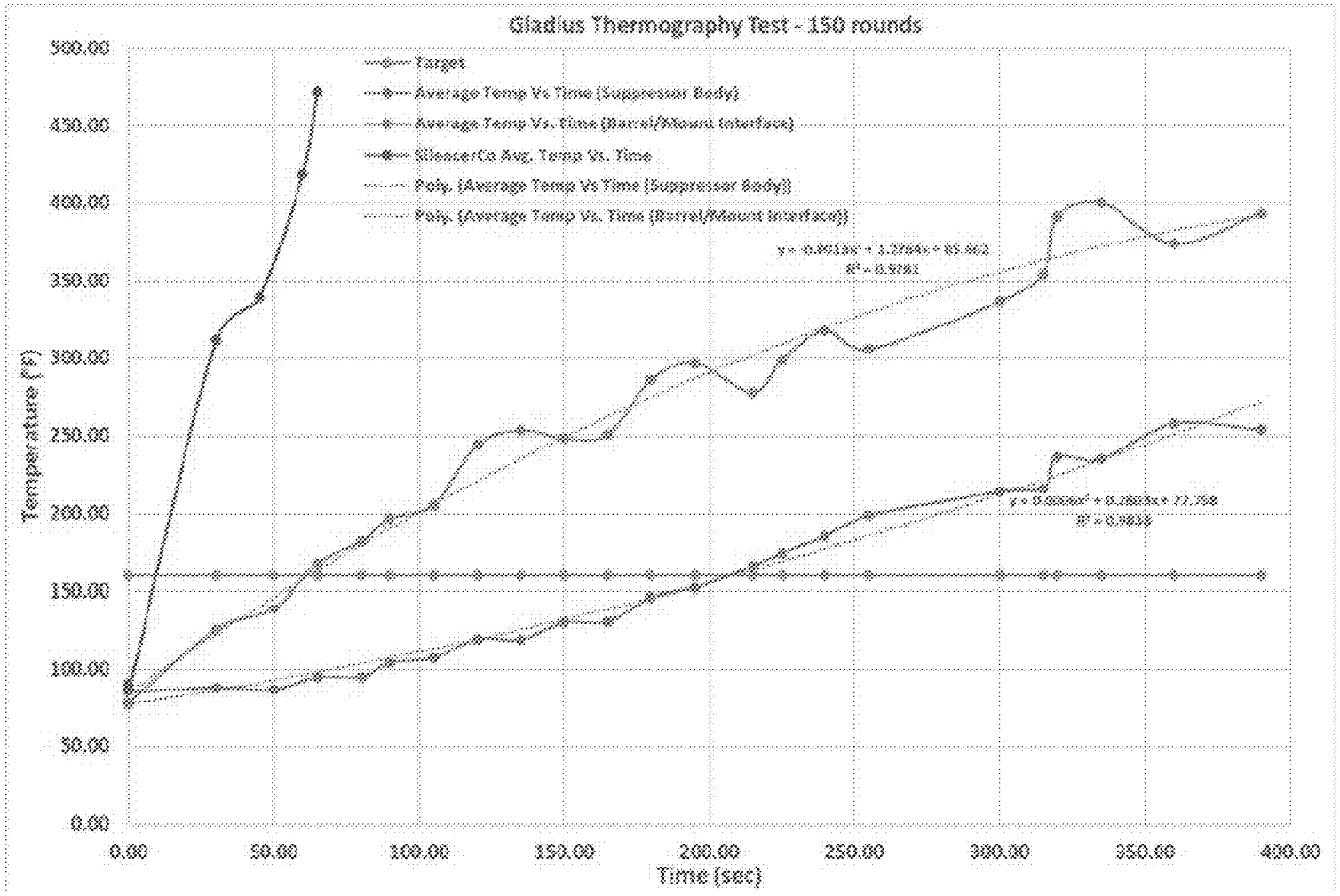
FIG. 25 shows a chart providing the testing results of a 150 Round Thermography Heat Up.
Figure 26:
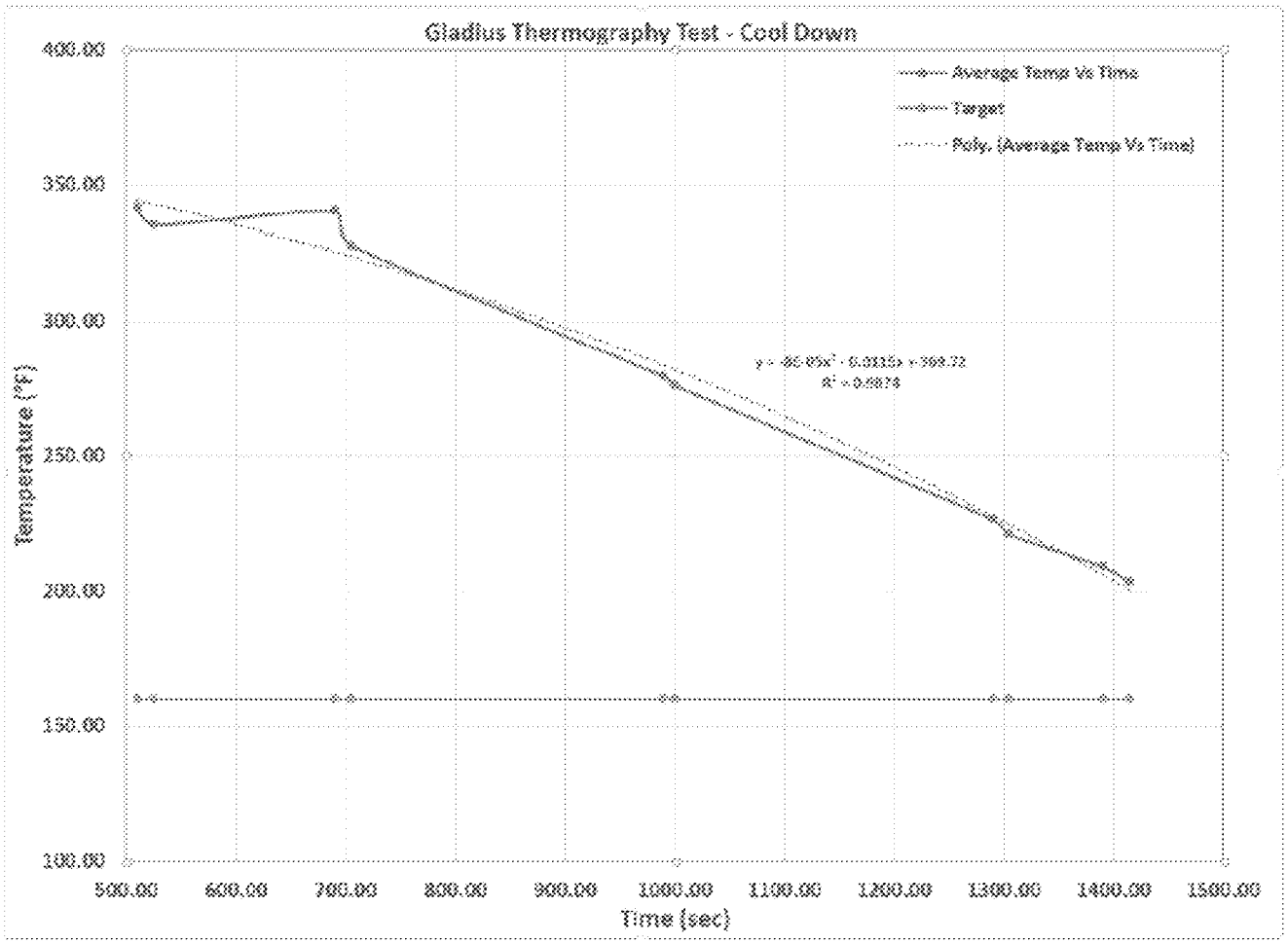
FIG. 26 shows the cool down of a suppressor of the current disclosure.

FIG. 23 at the top, with the rifle pointing to the left, shows the heat signature of a suppressor of the current disclosure after 65 seconds of fire expending firing 25 rounds used on a Falcor 10.5" barrel shooting Winchester 62 gr 5.56 ammo. The below portion of FIG. 23, with the gun pointing to the right, shows a markedly hotter heat signature after 60 second of fire expending 28 rounds. The comparative weapon was a colt 10.5" barrel with a silencer co-hybrid shooting Winchester 62 gr 5.56 ammo. As FIG. 23 shows, the comparative suppressor is literally glowing with heat. Conversely, the suppressor of the current background needs to be outlined in the top picture in order to differentiate it from the background of the shooting range. Indeed, FIG. 24 shows a screen shot of a video wherein a user is holding a suppressor of the current disclosure while firing, showing the effectiveness and heat shielding effectiveness of the current disclosure. FIG. 25 shows a chart providing the testing results of a 150 Round Thermography Heat Up. FIG. 26 shows the cool down of a suppressor of the current disclosure.

Figure 27:
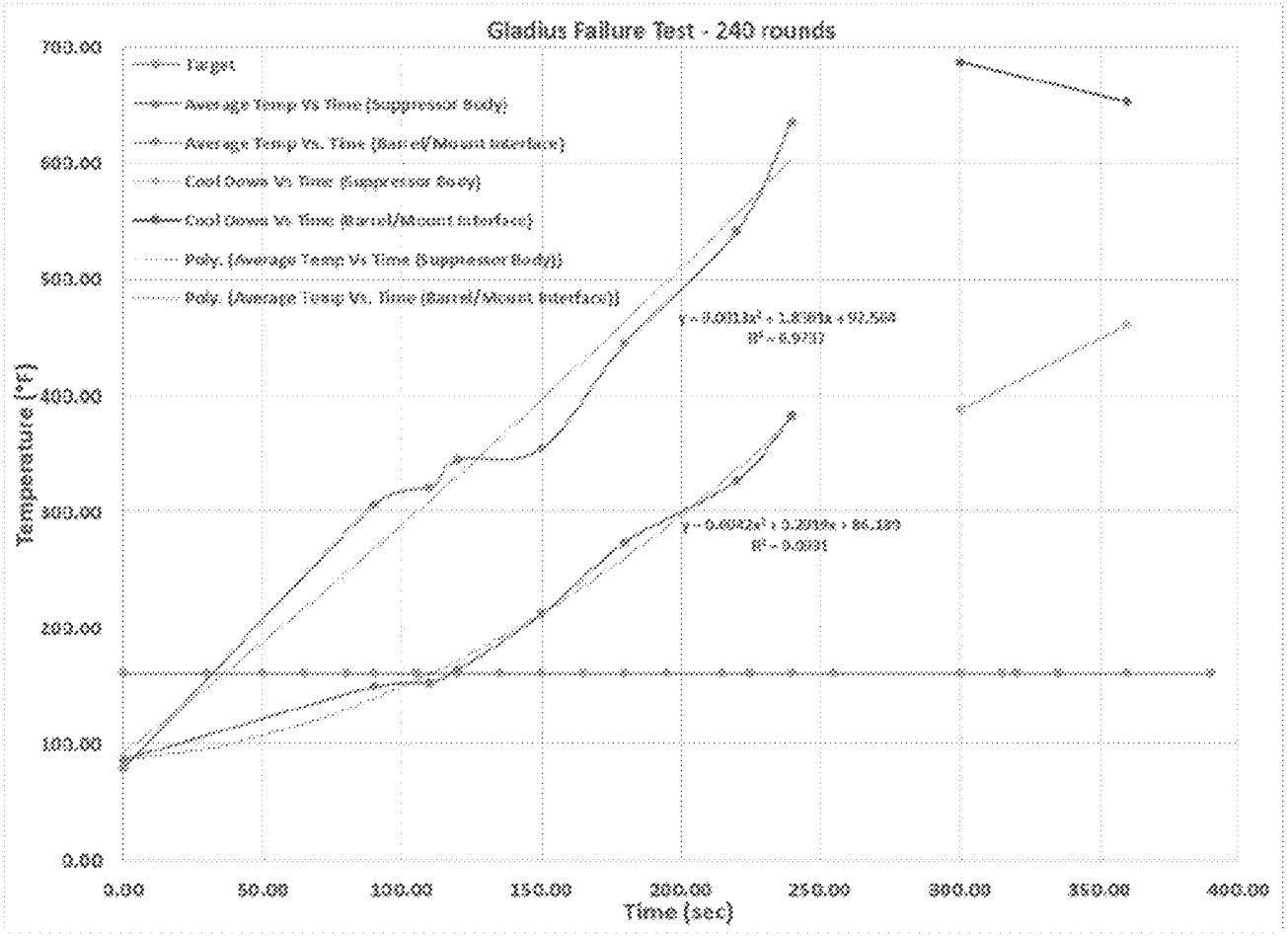
FIG. 27 shows the temperature results of the 240 Round Failure Test, both heat up and cool down.

Failure testing was also conducted. A 240 round "failure" test was conducted where shots were fired at a rate of approximately 1 shot per second (variable rate per magazine). Images were taken at approximately 10-30 second intervals starting at 90 seconds. Three was no "goal;" this test is for information gathering purposes only. Post-test cool down images were taken at: 1 minute post-test; 2 minutes post-test. Testing conditions were: 90° F. Ambient Temperature, 70% Relative Humidity, 0.85 Emissivity, IR Scans taken from ~2.5 meters away using a JenoptikVarioCAM-HiResIR Camera employing Irbis3 Software. FIG. 27 shows the temperature results of the 240 Round Failure Test, both heat up and cool down. FIG. 28 shows the raw data taken from the IR Thermography of the tests.

Further testing was conducted to determine the sound reduction qualities of a suppressor of the current disclosure. These tests were conducted using a 10.5" barreled AR 15 using 62 grain FMJ 5.56 ammunition. As FIG. 29 shows, decibel (DB) readings where recorded at the shooters ear and next to the muzzle. The louder reading is next to the muzzle the 132 db is next to the ear. Thus, the suppressor of the current disclosure is 132 db out of a 10.5" barrel. This was measured using an HT Instruments HT157 Sound Level Meter.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. An insulated suppressor for a rifle comprising:
a blast baffle;
a monocore baffle stack; and
an insulating sleeve comprising;
a continuous cylindrical wall;
a distal end cap, comprising a first recess, wherein the first recess contains a distal end cap insulation disk;
a proximal end cap, comprising a second recess, wherein the second recess contains a proximal end cap insulation disc;
the insulating sleeve substantially covering the entirety of a suppressor a second continuous cylindrical wall of the suppressor.

2. The insulated suppressor of claim 1, further comprising wherein the insulating sleeve is made integral with the suppressor.

3. The insulated suppressor of claim 1, further comprising wherein the insulating sleeve defines only two orifices within an outer surface of the insulating sleeve.

4. The insulated suppressor of claim 3, further comprising wherein one orifice is defined in the distal end cap and one orifice is defined in the proximal end cap.

5. The insulated suppressor of claim 1, further comprising wherein the monocore baffle stack comprises a sinusoidal structure.

6. The insulated suppressor of claim 1, further comprising a void defined between the continuous cylindrical wall and the second continuous cylindrical wall.

7. The insulated suppressor of claim 6, wherein the void is filled with an insulating material.

8. The insulated suppressor of claim 7, wherein the void filled with insulating material substantially covers the entirety of an outer circumference and length of the second continuous cylindrical wall.

9. The insulated suppressor of claim 7, wherein the insulating material comprises a ceramic and silica mixture.

10. The insulated suppressor of claim 7, wherein the insulating material underlies the distal end cap and proximal end cap.

11. The insulated suppressor of claim 6, wherein the void comprises a vacuum.

12. A method for reducing noise and heat generated from a suppressor comprising;

integrally forming an insulating sleeve around a suppressor;

wherein the insulating sleeve comprises;

a continuous cylindrical wall;

a distal end cap, configured to form a recess, wherein the recess contains a distal end cap insulation disk;

a proximal end cap, configured to form a recess, wherein the recess contains a proximal end cap insulation disc;

forming the insulating sleeve to substantially cover an outer surface of the suppressor;

forming a void around at least a circumference of the suppressor; and filling the void with an insulating material.

13. The method of claim 12, wherein only two orifices are formed in the insulating sleeve.

14. The method of claim 13, wherein a first orifice is formed in the proximal end cap and a second orifice is formed in the distal end cap.

15. The method of claim 12, further comprising forming a vacuum within the void.

16. The method of claim 12, wherein the insulating material comprises a ceramic and silica mixture.

17. The method of claim 12, further comprising forming the void to substantially circumferentially cover an outer circumference of a second continuous cylindrical wall of the suppressor.

18. The method of claim 17, further comprising forming the void to extend at least a length of the second cylindrical wall.

19. The method of claim 17, wherein integrally forming the insulated sleeve comprises permanently affixing the continuous cylindrical wall to the distal end cap and proximal end cap.

20. An insulated suppressor for a rifle comprising:

an inner insulating wall forming a continuous cylinder;

an outer insulating wall forming a continuous cylinder;

wherein the outer and inner insulating walls define a sealed void between the inner and outer insulating wall;

a distal end cap, configured to form a recess, wherein the recess contains a distal end cap insulation disk;

a proximal end cap, configured to form a recess, wherein the recess contains a proximal end cap insulation disc;

wherein the continuous cylinder of the inner insulating wall surrounds:

a blast baffle; and a monocore baffle stack; and wherein a carbon fiber wrap at least partially surrounds the outer insulating wall.

* * * * *